US012331934B2

(12) United States Patent
Ootani et al.

(10) Patent No.: US 12,331,934 B2
(45) Date of Patent: Jun. 17, 2025

(54) HEATING COOKING APPARATUS

(71) Applicant: SHARP KABUSHIKI KAISHA, Sakai (JP)

(72) Inventors: Tsuyoshi Ootani, Sakai (JP); Masahiro Nishijima, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 422 days.

(21) Appl. No.: 17/796,934

(22) PCT Filed: Feb. 2, 2021

(86) PCT No.: PCT/JP2021/003690
§ 371 (c)(1),
(2) Date: Aug. 2, 2022

(87) PCT Pub. No.: WO2021/157560
PCT Pub. Date: Aug. 12, 2021

(65) Prior Publication Data

US 2023/0067149 A1 Mar. 2, 2023

(30) Foreign Application Priority Data

Feb. 7, 2020 (JP) ..... 2020-019682

(51) Int. Cl.
*F24C 15/18* (2006.01)
*F24C 15/02* (2006.01)
*F24C 15/16* (2006.01)

(52) U.S. Cl.
CPC ..... *F24C 15/18* (2013.01); *F24C 15/02* (2013.01); *F24C 15/162* (2013.01)

(58) Field of Classification Search
CPC ..... F24C 15/02; F24C 15/162; F24C 15/18; F24C 15/16; F24C 15/168; A21B 3/02;
(Continued)

(56) References Cited

U.S. PATENT DOCUMENTS 8,490,614 B1 * 7/2013 Gregory ..... A47J 37/0754 126/41 R
2005/0173399 A1 * 8/2005 Yoshidome ..... H05B 6/763 219/403
(Continued)

FOREIGN PATENT DOCUMENTS

JP 2011-089738 A 5/2011

*Primary Examiner* — Jorge A Pereiro
(74) *Attorney, Agent, or Firm* — ScienBiziP, P.C.

(57) ABSTRACT

A heating cooking apparatus includes a heating cooking chamber, a pull-out portion, and a placement member. The pull-out portion is configured to be pulled out from the heating cooking chamber in a first direction. The placement member is placed on the pull-out portion. The placement member includes a placement portion and a pair of protrusion portions. The pair of protrusion portions protrudes from the placement portion in a second direction. The pull-out portion includes a base portion and a pair of side wall portions. The placement member is placed on the base portion. The pair of side wall portions extends in the first direction, stands upright from the base portion, and faces each other in the second direction. The pair of side wall portions respectively includes a pair of concave portions recessed in a third direction. The pair of protrusion portions is respectively disposed in the pair of concave portions.

8 Claims, 17 Drawing Sheets

(58) Field of Classification Search
CPC ... H05B 6/6414; H05B 6/6485; H05B 6/6411
USPC ..... 126/37 R
See application file for complete search history.

(56) References Cited

U.S. PATENT DOCUMENTS

| | | | | |
|---|---|---|---|---|
| 2007/0029317 | A1* | 2/2007 | Kang | H05B 6/782<br>219/754 |
| 2013/0025472 | A1* | 1/2013 | Stanger | F24C 15/16<br>99/448 |
| 2016/0195280 | A1* | 7/2016 | Adelmann | F24C 15/023<br>126/340 |
| 2016/0345388 | A1* | 11/2016 | Nakamura | H05B 6/6414 |
| 2017/0030588 | A1* | 2/2017 | Unwin | A23L 5/15 |
| 2017/0311394 | A1* | 10/2017 | Shibuya | A47J 27/04 |
| 2018/0313545 | A1* | 11/2018 | Jeong | F24C 15/168 |
| 2019/0142218 | A1* | 5/2019 | Popeil | A47J 37/0694<br>426/302 |
| 2019/0186756 | A1* | 6/2019 | Tiefnig | A21B 3/02 |
| 2020/0025392 | A1* | 1/2020 | Balekundri | F24C 15/028 |

* cited by examiner

HEATING COOKING APPARATUS

TECHNICAL FIELD

The present invention relates to a heating cooking apparatus.

BACKGROUND ART

PTL 1 discloses a heating cooking apparatus. The heating cooking apparatus disclosed in PTL 1 includes a heating chamber, a saucer, a rail unit, a grill, and a damper. The rail unit puts the saucer into and out of the heating chamber. The damper alleviates an impact during retraction. The saucer is placed on the saucer. An object to be cooked is placed on the grill.

CITATION LIST

Patent Literature

PTL 1: JP 2011-89738 A

SUMMARY OF INVENTION

Technical Problem

However, in the heating cooking apparatus disclosed in PTL 1, a placement member such as a tray placed on a saucer may move beyond a specified range. In particular, when the placement member moves beyond the specified range in a case where an object to be cooked is heated by microwaves, a distance between a grill placed on the placement member and another metal member decreases. As a result, discharging may occur between the grill and the other metal member.

In view of the above-described problems, an object of the present invention is to provide a heating cooking apparatus that can suppress movement of a placement member with respect to a pull-out portion due to an impact when the pull-out portion moves.

Solution to Problem

According to one aspect of the present invention, a heating cooking apparatus includes a heating cooking chamber, a pull-out portion, and a placement member. The pull-out portion is configured to be pulled out from the heating cooking chamber in a first direction. The placement member is placed on the pull-out portion. The placement member includes a placement portion and a pair of protrusion portions. An object is placed on the placement portion. The pair of protrusion portions protrude from the placement portion in a second direction intersecting the first direction. The pull-out portion includes a base portion and a pair of side wall portions. The placement member is placed on the base portion. The pair of side wall portions extend in the first direction, stand upright from the base portion, and face each other in the second direction. The pair of side wall portions respectively include a pair of concave portions recessed in a third direction intersecting the first direction and the second direction. The pair of protrusion portions are respectively disposed in the pair of concave portions.

Advantageous Effects of Invention

According to a heating cooking apparatus of the present invention, it makes it possible to suppress movement of a placement member with respect to a pull-out portion due to an impact when the pull-out portion moves.

DESCRIPTION OF EMBODIMENTS

Figure 1:
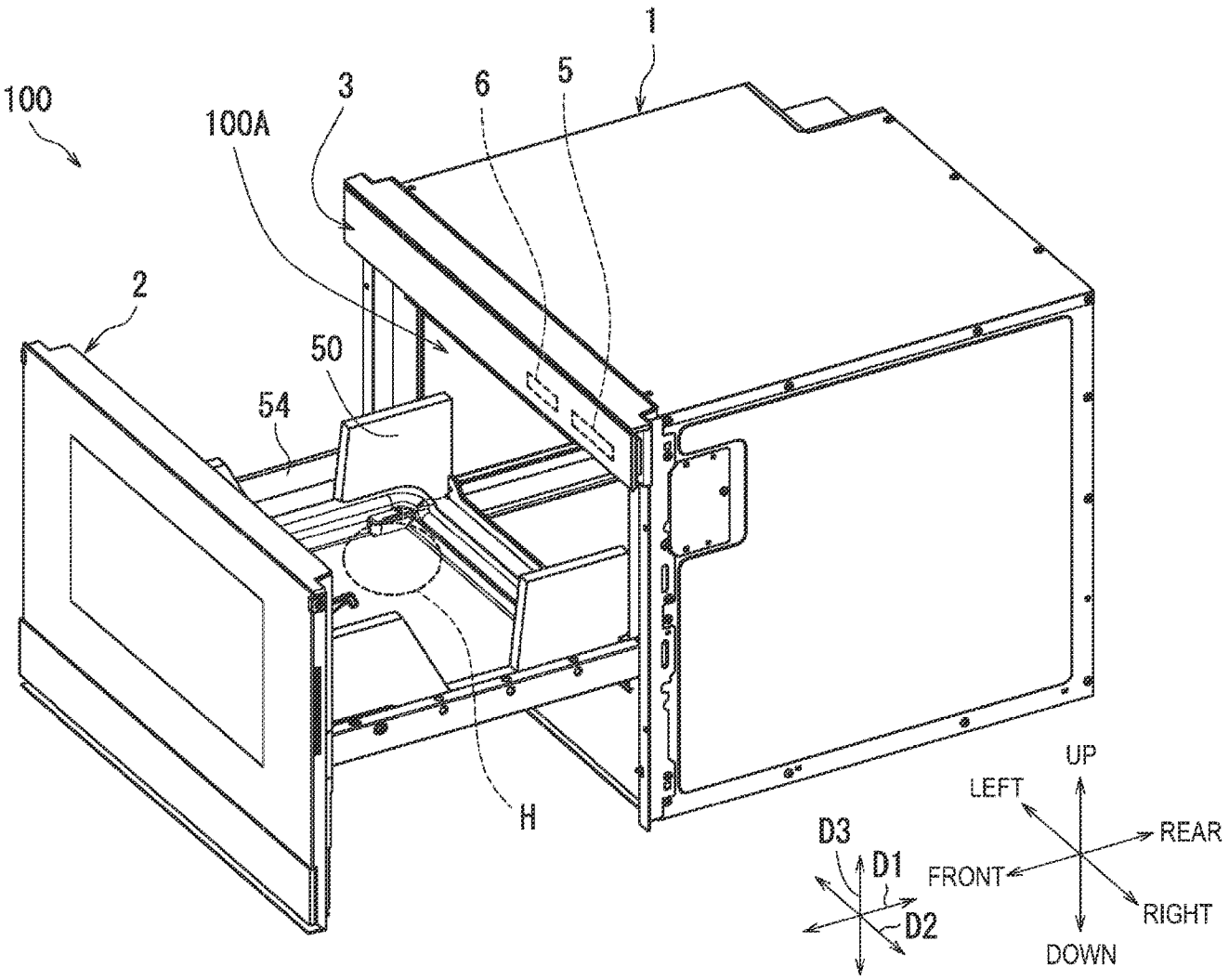
FIG. 1 is a perspective view illustrating a pull-out type heating cooking apparatus according to a first embodiment of the present invention.

Hereinafter, embodiments of a pull-out type heating cooking apparatus according to the present invention will be described with reference to the drawings. Note that, in the drawings, the same or equivalent components are denoted by the same reference numerals and signs, and description thereof will not be repeated.

First Embodiment

Figure 2:
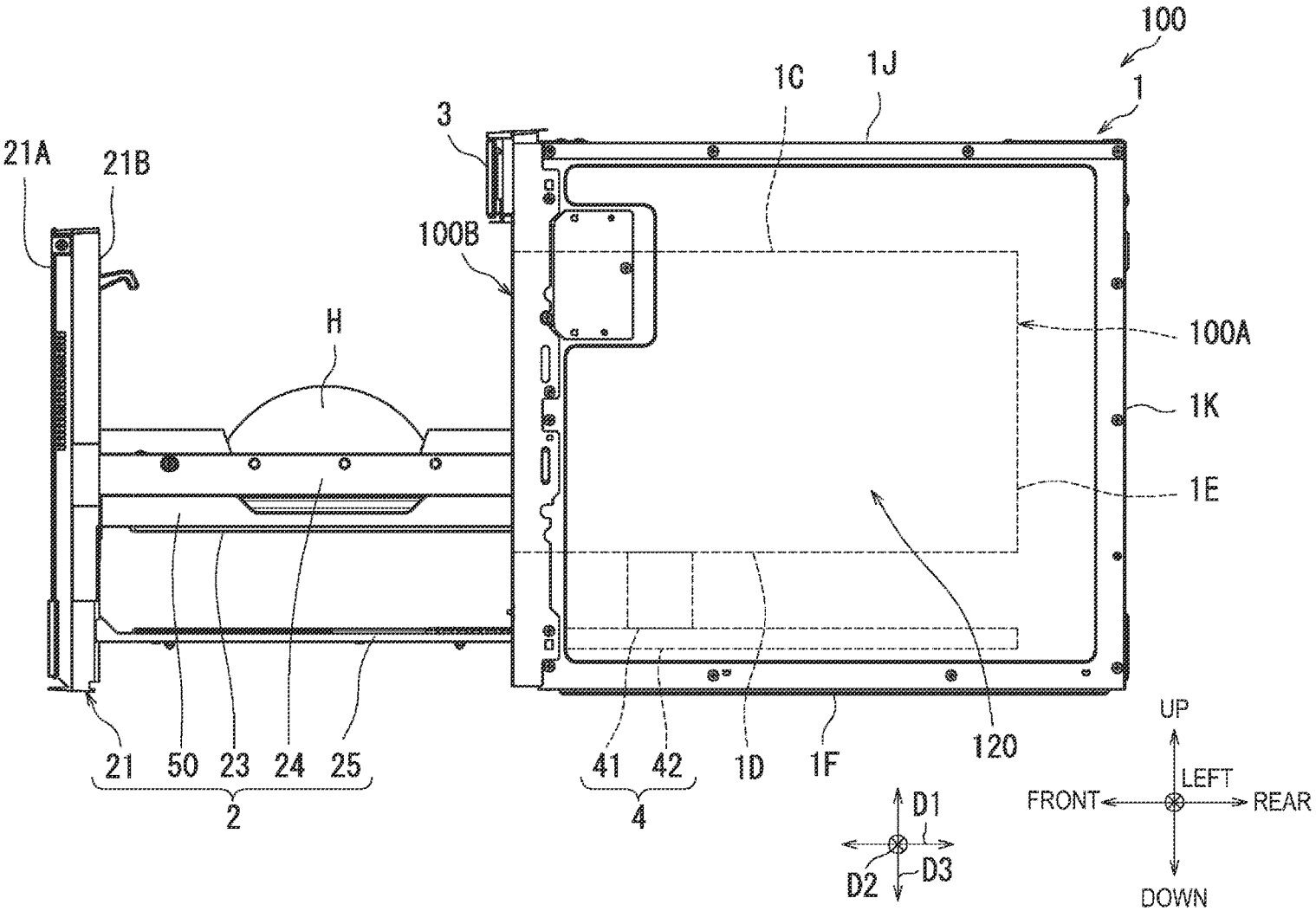
FIG. 2 is a right side view illustrating the pull-out type heating cooking apparatus according to the first embodiment.
Figure 3:
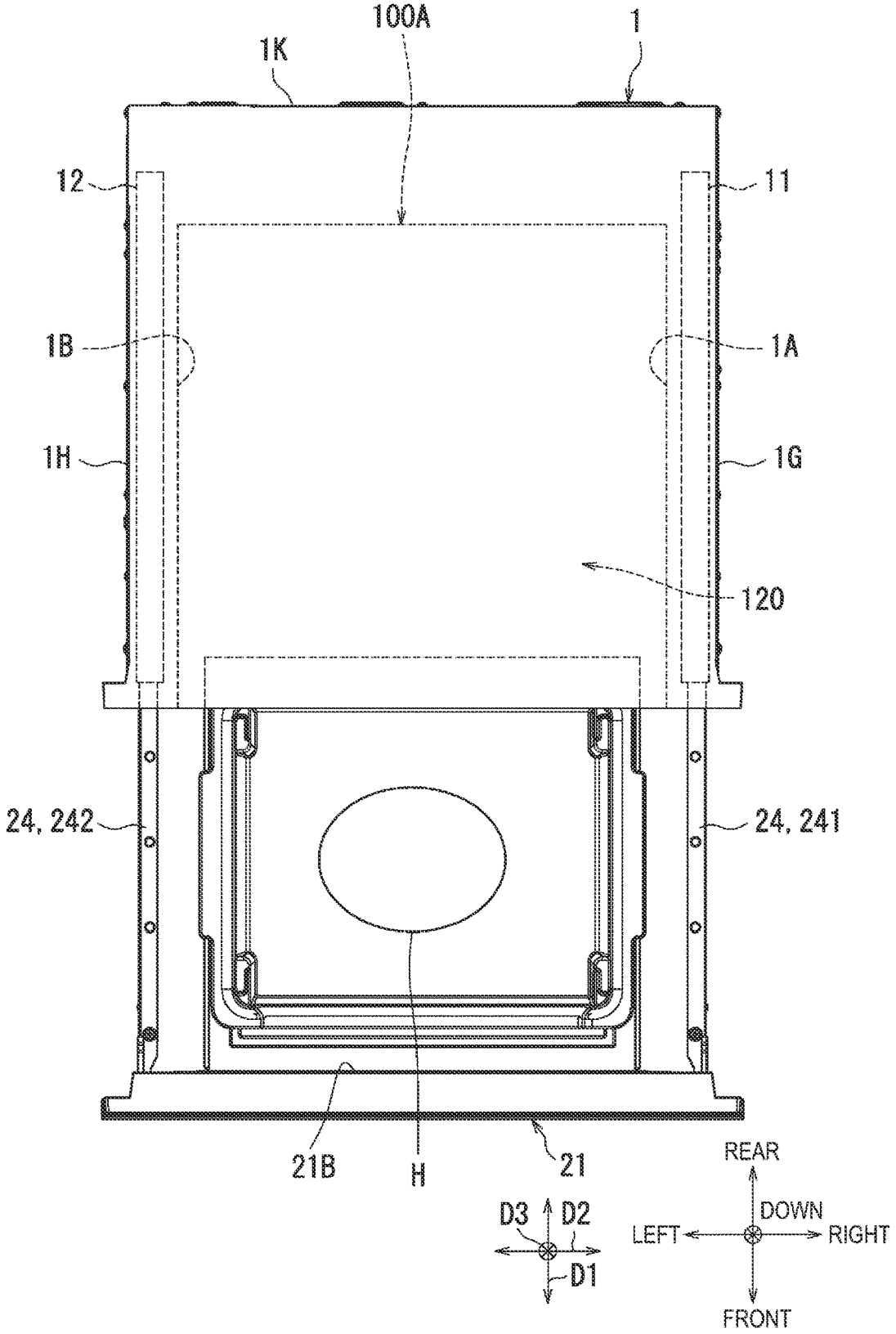
FIG. 3 is a top view illustrating the pull-out type heating cooking apparatus according to the first embodiment.

A pull-out type heating cooking apparatus 100 according to a first embodiment will be described with reference to FIG. 1 to FIG. 3. FIG. 1 is a perspective view illustrating the pull-out type heating cooking apparatus 100. FIG. 2 is a right side view illustrating the pull-out type heating cooking apparatus 100. FIG. 3 is a top view illustrating the pull-out type heating cooking apparatus 100. More specifically, FIG.

1 to FIG. 3 illustrate the pull-out type heating cooking apparatus 100 in a state where a pull-out body 2 is pulled out. Further, FIG. 1 illustrates the appearance of the pull-out type heating cooking apparatus 100 viewed from the front in an upper right diagonal direction. The pull-out type heating cooking apparatus 100 is an example of a heating cooking apparatus.

As illustrated in FIG. 1, the pull-out type heating cooking apparatus 100 heats and cooks an object H to be heated. The object H to be heated is, for example, a food product. As illustrated in FIG. 1, the pull-out type heating cooking apparatus 100 includes a heating chamber 1, the pull-out body 2, an operation panel 3, a control unit 5, and a storage unit 6. The pull-out body 2 is an example of a pull-out portion.

In the first embodiment, a side on which the operation panel 3 of the pull-out type heating cooking apparatus 100 is disposed is defined as a front side of the pull-out type heating cooking apparatus 100, and a side (back side) opposite to the front side is defined as a rear side of the pull-out type heating cooking apparatus 100. Further, a right side when the pull-out type heating cooking apparatus 100 is viewed from the side in front is defined as a right side of the pull-out type heating cooking apparatus 100, and a side opposite to the right side is defined as a left side of the pull-out type heating cooking apparatus 100. Further, in a direction orthogonal to a front-rear direction and a right-left direction of the pull-out type heating cooking apparatus 100, a side on which the operation panel 3 is disposed is defined as an upper side of the pull-out type heating cooking apparatus 100, and a side (bottom side) opposite to the upper side is defined as a lower side of the pull-out type heating cooking apparatus 100. Note that these orientations do not limit an orientation of the pull-out type heating cooking apparatus 100 according to the present invention in use.

As illustrated in FIG. 1 to FIG. 3, the heating chamber 1 is a box-like member. Specifically, the heating chamber 1 includes a right outer wall 1G, a left outer wall 1H, a top outer wall 1J, a bottom outer wall 1F, and a back outer wall 1K. The heating chamber 1 also includes a heating cooking chamber 100A therein. The heating cooking chamber 100A is positioned inside the heating chamber 1.

The heating cooking chamber 100A includes an accommodation space 120 that accommodates the object H to be heated. The accommodation space 120 has a predetermined capacity as a space that can accommodate the object H to be heated. The heating cooking chamber 100A further includes a right wall 1A, a left wall 1B, a top wall 1C, a bottom wall 1D, and a back wall 1E. The shape of the heating cooking chamber 100A is, for example, a substantially rectangular parallelepiped shape. Materials of the right wall 1A, the left wall 1B, the top wall 1C, the bottom wall 1D, and the back wall 1E are, for example, metal. The heating cooking chamber 100A further includes an opening 100B that communicates with the outside of the heating cooking chamber 100A. Specifically, the front side of the heating cooking chamber 100A may be opened to allow the object H to be heated to be put into and out.

The heating chamber 1 further includes a space between the bottom wall 1D and the bottom outer wall 1F. The heating chamber 1 further includes a space between the right wall 1A and the right outer wall 1G. The heating chamber 1 further includes a space between the left wall 1B and the left outer wall 1H. The heating chamber 1 further includes a space between the top wall 1C and the top outer wall 1J. The heating chamber 1 further includes a space between the back wall 1E and the back outer wall 1K.

The operation panel 3 includes an operation unit and a display unit. The operation unit receives an operation from a user. The operation unit includes various types of keys. The display unit displays various pieces of information. The display unit includes a liquid crystal panel. The operation panel 3 is positioned at an upper portion of a front surface of the heating chamber 1.

The storage unit 6 is constituted by a Random Access Memory (RAM) and a Read Only Memory (ROM). The storage unit 6 stores a control program for controlling an operation of each unit of the pull-out type heating cooking apparatus 100. The storage unit 6 stores setting information input when the operation panel 3 is operated.

The control unit 5 is a hardware circuit that includes a processor such as a Central Processing Unit (CPU). The control unit 5 executes the control program stored in the storage unit 6.

Figure 4:
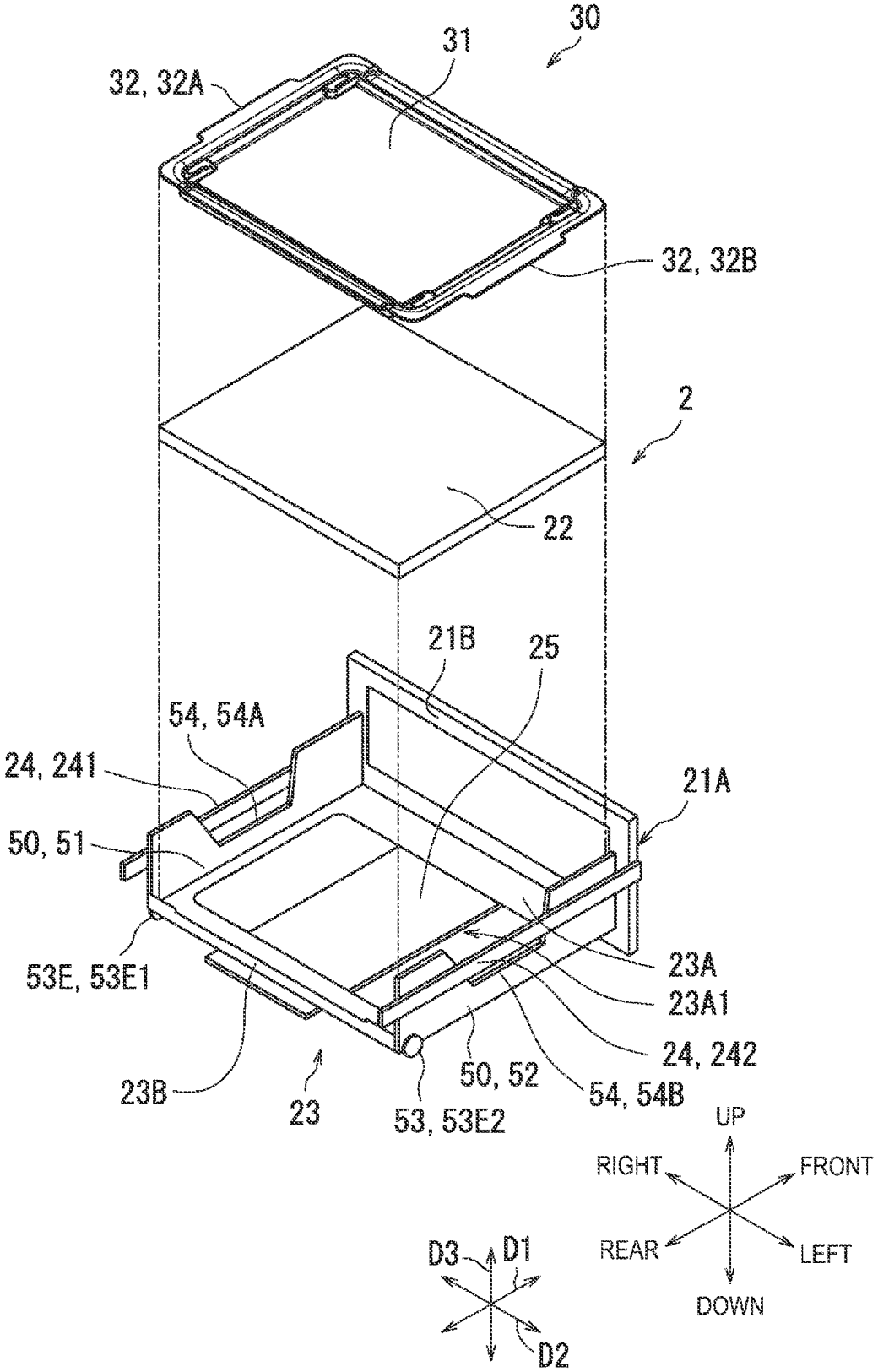
FIG. 4 is an exploded perspective view illustrating a pull-out body and a tray according to the first embodiment.

Next, the pull-out body 2 according to the first embodiment will be described with reference to FIG. 1 to FIG. 4. FIG. 4 is an exploded perspective view illustrating the pull-out body 2 and the tray 30. The tray 30 is an example of a placement member.

As illustrated in FIG. 1 to FIG. 3, the pull-out body 2 can be pulled out from the heating cooking chamber 100A in a first direction D1. The first direction D1 is along the front-rear direction. A second direction D2 intersects the first direction D1. In the first embodiment, the second direction D2 is orthogonal to the first direction D1. The second direction D2 is along the right-left direction. A third direction D3 intersects the first direction D1 and the second direction D2. In the first embodiment, the third direction D3 is orthogonal to the first direction D1 and the second direction D2. The third direction D3 is along the up-down direction. Specifically, the pull-out body 2 includes a door portion 21.

The door portion 21 can open and close the opening portion 100B on the front side of the heating cooking chamber 100A. The door portion 21 is a substantially rectangular plate-like member. The door portion 21 includes a front surface 21A and a rear surface 21B. The door portion 21 opens the opening 100B on the front side of the heating cooking chamber 100A in a state where the pull-out body 2 is pulled out from the heating cooking chamber 100A. The door portion 21 closes the opening 100B on the front side of the heating cooking chamber 100A in a state where the pull-out body 2 is pulled into the heating cooking chamber 100A. Note that, in a state where the pull-out body 2 is pulled into the heating cooking chamber 100A, a distance between the top wall 1C and the bottom wall 1D is shorter than a distance between the back wall 1E and the rear surface 21B.

As illustrated in FIG. 4, the pull-out body 2 further includes a base portion 22, a pair of side wall portions 50, and a support portion 23. The base portion 22 is a rectangular plate-like member. The base portion 22 moves between an accommodation position in the heating cooking chamber 100A and a pull-out position outside the heating cooking chamber 100A. The tray 30 is placed on the base portion 22. The base portion 22 is, for example, a plate-like member made of a ceramic, glass, or a synthetic resin, and is preferably a plate-like member made of a ceramic or glass. As a result, the base portion 22 transmits microwaves.

The support portion 23 is fixed to the rear surface 21B of the door portion 21 and supports a peripheral edge portion of the base portion 22 such that the base portion 22 is held in a horizontal state. Specifically, the support portion 23 includes a base plate portion 23A and a back plate portion 23B. A material of the support portion 23 is, for example, a metal.

The base plate portion 23A includes a rectangular opening 23A1. The rectangular opening 23A1 is positioned at substantially a center portion of the base plate portion 23A. The back plate portion 23B stands upright upward from the peripheral edge portion of the base plate portion 23A.

The base portion 22 is fitted between the door portion 21 and the back plate portion 23B. In addition, the peripheral edge portion of the base portion 22 is fixed to an upper surface of the peripheral edge portion of the base plate portion 23A.

Each of the pair of side wall portions 50 extends in the first direction D1. Additionally, each of the pair of side wall portions 50 stands upright in the third direction D3 from the base portion 22. The pair of side wall portions 50 face each other in the second direction D2. Specifically, one side wall portion of the pair of side wall portions 50 includes a right side plate portion 51, and the other side wall portion of the pair of side wall portions 50 includes a left side plate portion 52. Materials of the right side plate portion 51 and the left side plate portion 52 are, for example, metals. The right side plate portion 51 and the left side plate portion 52 stand upright upward from the peripheral edge portion of the base plate portion 23A.

The pair of side wall portions 50 respectively include a pair of concave portions 54. Each of the pair of concave portions 54 is recessed in the third direction D3. Specifically, one concave portion of the pair of concave portions 54 includes a right side concave portion 54A, and the other concave portion of the pair of concave portions 54 includes a left side concave portion 54B. Specifically, each of the right side concave portion 54A and the left side concave portion 54B has a shape smaller downward.

The support portion 23 further includes a pair of rollers 53E. The pair of rollers 53E rotate as the pull-out body 2 moves. Specifically, one roller of the pair of rollers 53E includes a right side roller 53E1, and the other roller of the pair of rollers 53E includes a left side roller 53E2. In addition, the right side roller 53E1 is attached to a rear end portion of the right side plate portion 51. The left side roller 53E2 is attached to a rear end portion of the left side plate portion 52.

Next, the tray 30 will be described. The tray 30 is placed on the pull-out body 2. The tray 30 is a bottomed plate-like member. Specifically, the tray 30 includes a placement portion 31 and a pair of protrusion portions 32.

An object is placed on the placement portion 31. The object is, for example, an object H to be heated. The placement portion 31 has a substantially rectangular shape when viewed from the upper side to the lower side. The placement portion 31 is fitted between the right side plate portion 51 and the left side plate portion 52.

The pair of protrusion portions 32 protrude from the placement portion 31 in the second direction D2 so as to be separated from each other. Specifically, one protrusion portion of the pair of protrusion portions 32 includes a first protrusion portion 32A, and the other protrusion portion of the pair of protrusion portions 32 includes a second protrusion portion 32B. Specifically, the first protrusion portion 32A extends in the right direction from the placement portion 31. Additionally, the second protrusion portion 32B extends in the left direction from the placement portion 31. More specifically, the shape of each of the first protrusion portion 32A and the second protrusion portion 32B is a trapezoidal plate-like member that becomes smaller in an outward direction.

The pair of protrusion portions 32 are respectively disposed in the pair of concave portions 54. More specifically, the first protrusion portion 32A is disposed in the right side concave portion 54A. The second protrusion portion 32B is disposed in the left side concave portion 54B. Specifically, the first protrusion portion 32A is disposed in the right side concave portion 54A from above. The second protrusion portion 32B is disposed in the left side concave portion 54B from above. In addition, the first protrusion portion 32A fits into the right side concave portion 54A and protrudes outward. The second protrusion portion 32B fits into the left side concave portion 54B and protrudes outward.

The tray 30 is made of a non-metal, is a plate-like member made of a ceramic, glass, or a synthetic resin, for example, and is preferably a plate-like member made of a ceramic or glass. As a result, the tray 30 transmits microwaves.

Next, the pull-out body 2 will be further described. The pull-out body 2 further includes a pair of slide members 24 and a support member 25.

The pair of slide members 24 extend in the front-rear direction and define the movement direction of the pull-out body 2. The pair of slide members 24 are fixed to the rear surface 21B of the door portion 21.

Specifically, one slide member of the pair of slide members 24 includes a right side slide member 241, and the other slide member of the pair of slide members 24 includes a left side slide member 242. Each of the right side slide member 241 and the left side slide member 242 is, for example, a member having the front-rear direction as a longitudinal direction. The right side slide member 241 and the left side slide member 242 oppose each other in the right-left direction. One end portion of the right side slide member 241 is attached to a right edge portion of the rear surface 21B of the door portion 21. One end portion of the left side slide member 242 is attached to a left edge portion of the rear surface 21B of the door portion 21.

Note that, the heating chamber 1 further includes a right side slide rail 11 and a left side slide rail 12. The right side slide rail 11 is fixed in a space between the right wall 1A and the right outer wall 1G. The left side slide rail 12 is fixed in a space between the left wall 1B and the left outer wall 1H. Each of the right side slide rail 11 and the left side slide rail 12 is a member having the front-rear direction as a longitudinal direction. The right side slide member 241 is supported slidably along the right side slide rail 11. The left side slide member 242 is supported slidably along the left side slide rail 12.

The support member 25 supports the door portion 21. Specifically, the support member 25 extends in the first direction D1 and defines the movement direction of the pull-out body 2. One end portion of the support member 25 is attached at a center portion in the right-left direction of the rear surface 21B of the door portion 21 and below the base portion 22. The support member 25 is, for example, a plate-like member having the front-rear direction as a longitudinal direction. The support member 25 includes a rack portion. The rack portion includes a plurality of teeth. The support member 25 may be a single plate-like member or a plurality of plate-like members.

Note that, as illustrated in FIG. 2, the heating chamber 1 further includes a drive mechanism 4. The drive mechanism 4 drives the support member 25. In addition, the drive mechanism 4 is positioned below the heating cooking chamber 100A. Specifically, the drive mechanism 4 is accommodated in a space between the bottom wall 1D and the bottom outer wall 1F. For example, the drive mechanism 4 includes a drive motor 41, a pinion, and a drive rail 42. The drive rail 42 is fixed in a space between the bottom wall 1D and the bottom outer wall 1F. The drive rail 42 is a member having the front-rear direction as a longitudinal direction. The support member 25 is supported slidably along the drive rail 42. The pinion is attached to a tip end portion of the drive motor 41. The pinion engages with the rack portion of the support member 25. Furthermore, the support member 25 moves in the front-rear direction as a result of rotation of the pinion. As a result, the pull-out body 2 moves between the accommodation position and the pull-out position. Note that the drive mechanism 4 may drive at least one of the support member 25, the right side slide member 241, and the left side slide member 242. Further, in a case where the right side slide member 241 and the left side slide member 242 are driven, the drive mechanism 4 may be positioned on the side of the heating cooking chamber 100A.

As described above with reference to FIG. 1 to FIG. 4, according to the first embodiment, the pair of protrusion portions 32 are respectively disposed in the pair of concave portions 40. Thus, it makes it possible to suppress the movement of the tray 30 with respect to the pull-out body 2 due to an impact when the pull-out body 2 moves. As a result, the object H to be heated which is placed on the tray 30 can be heated appropriately. The object H to be heated is an example of an object.

Figure 5:
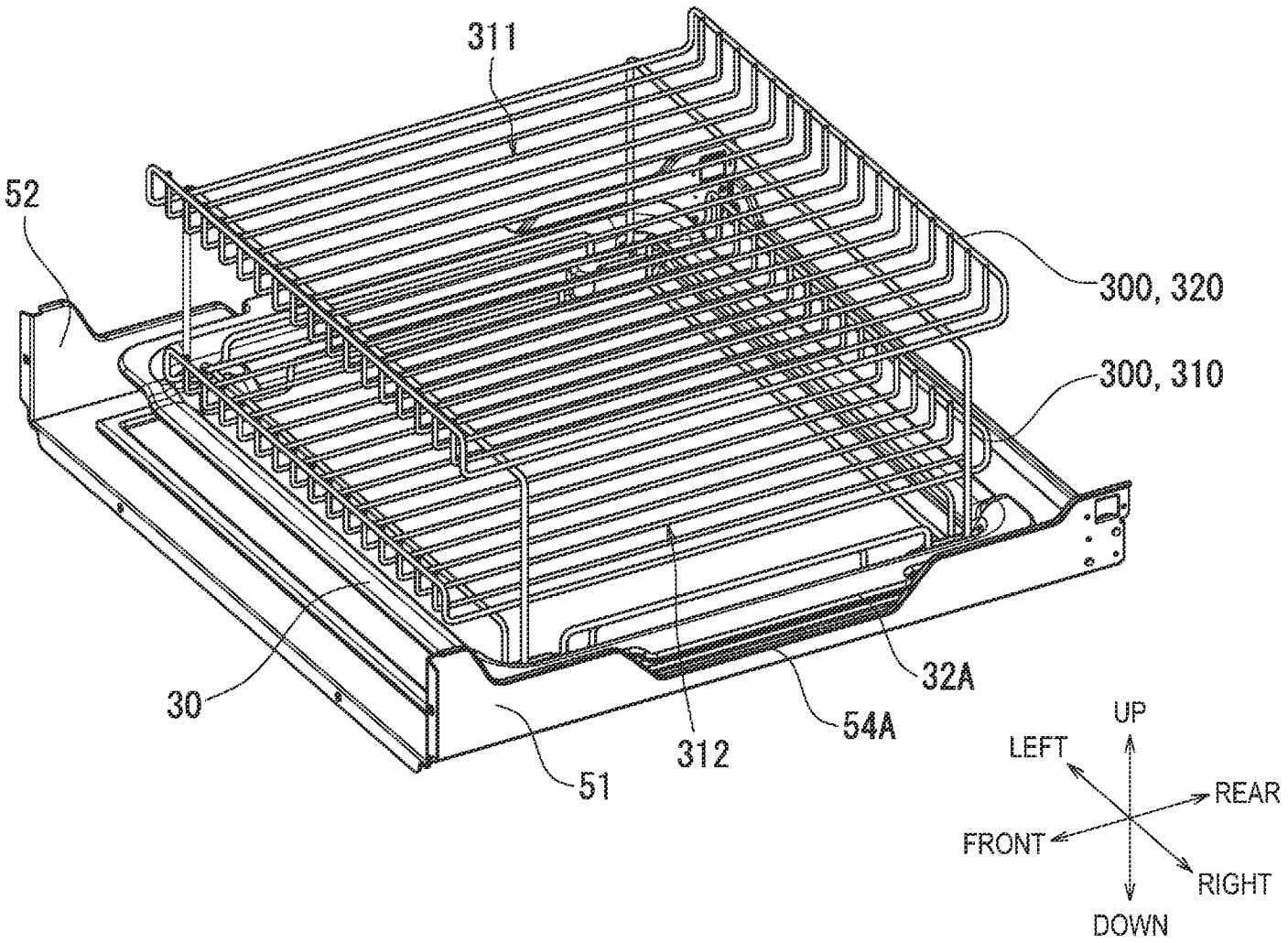
FIG. 5 is a perspective view illustrating a plurality of grid bodies, the pull-out body, and the tray according to the first embodiment.

Next, grid bodies 300 will be specifically described with reference to FIG. 5. FIG. 5 is a perspective view illustrating the grid bodies 300, the pull-out body 2, and the tray 30. The pull-out type heating cooking apparatus 100 further includes the grid bodies 300 as objects. As illustrated in FIG. 5, the pull-out type heating cooking apparatus 100 further includes at least one grid body 300. In the first embodiment, the at least one grid body 300 includes a first grid body 310 and a second grid body 320. The second grid body 320 is displayed on the tray 30 so as to be separated above from the first grid body 310.

Figure 6:
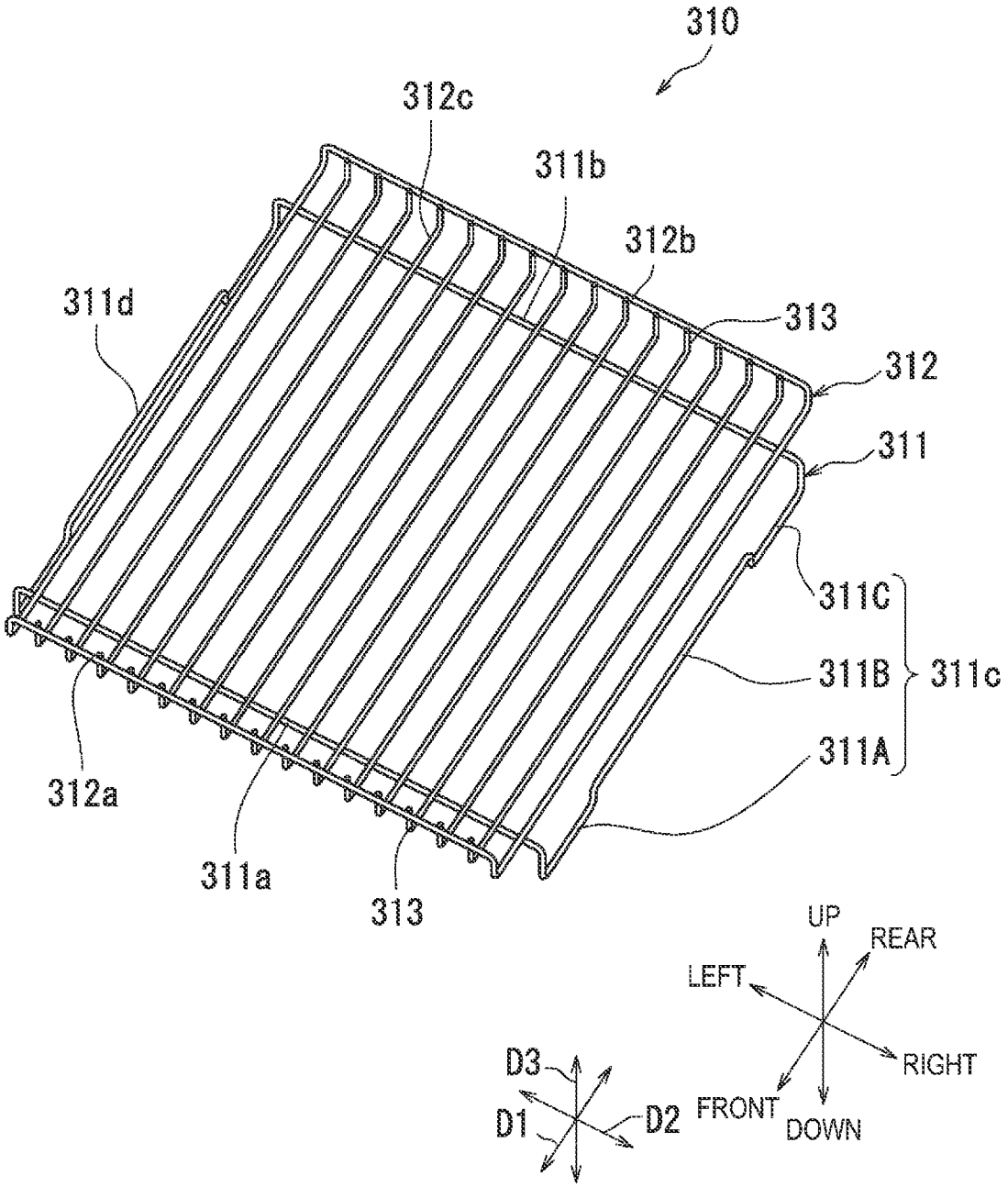
FIG. 6 is a perspective view illustrating a first grid body according to the first embodiment.

Next, the first grid body 310 will be specifically described with reference to FIG. 6. FIG. 6 is a perspective view illustrating the first grid body 310.

As illustrated in FIG. 6, the first grid body 310 includes a support portion 311 and a placement portion 312. Specifically, the placement portion 312 includes a front side metal rod 312*a*, a rear side metal rod 312*b*, and a plurality of metal rods 312*c*. Each of the front side metal rod 312*a* and the rear side metal rod 312*b* extends in the second direction D2.

Each of the plurality of metal rods 312*c* extends in the first direction D1. Specifically, one end of each of the plurality of metal rods 312*c* is connected to the front side metal rod 312*a*, and the other end of each of the plurality of metal rods 312*c* is connected to the rear side metal rod 312*b*. Further, in the plurality of metal rods 312*c*, the metal rods adjacent to each other in the second direction D2 are disposed at a predetermined interval. The object H to be heated is placed on the plurality of metal rods 312*c*.

The shape of the support portion 311 is, for example, a substantially quadrangular ring shape. Specifically, the support portion 311 includes a front side metal rod 311*a*, a rear side metal rod 311*b*, a right side metal rod 311*c*, and a left side metal rod 311*d*. Each of the right side metal rod 311*c* and the left side metal rod 311*d* includes a first low portion 311A, a high portion 311B, and a second low portion 311C. The first low portion 311A and the second low portion 311C are examples of a first leg portion. The high portion 311B is disposed between the first low portion 311A and the second low portion 311C. The height of each of the first low portion 311A and the second low portion 311C is lower than the height of the high portion 311B. As a result, deflection of the support portion 311 can be suppressed because the support portion 311 does not form a straight line.

In addition, each of lower surfaces of one end portions of the plurality of metal rods 312*c* is connected to the front side metal rod 311*a*, and each of lower surfaces of the other end portions of the plurality of metal rods 312*c* is connected to the rear side metal rod 311*b*. As a result, the placement portion 312 is positioned above the support portion 311.

Figure 7:
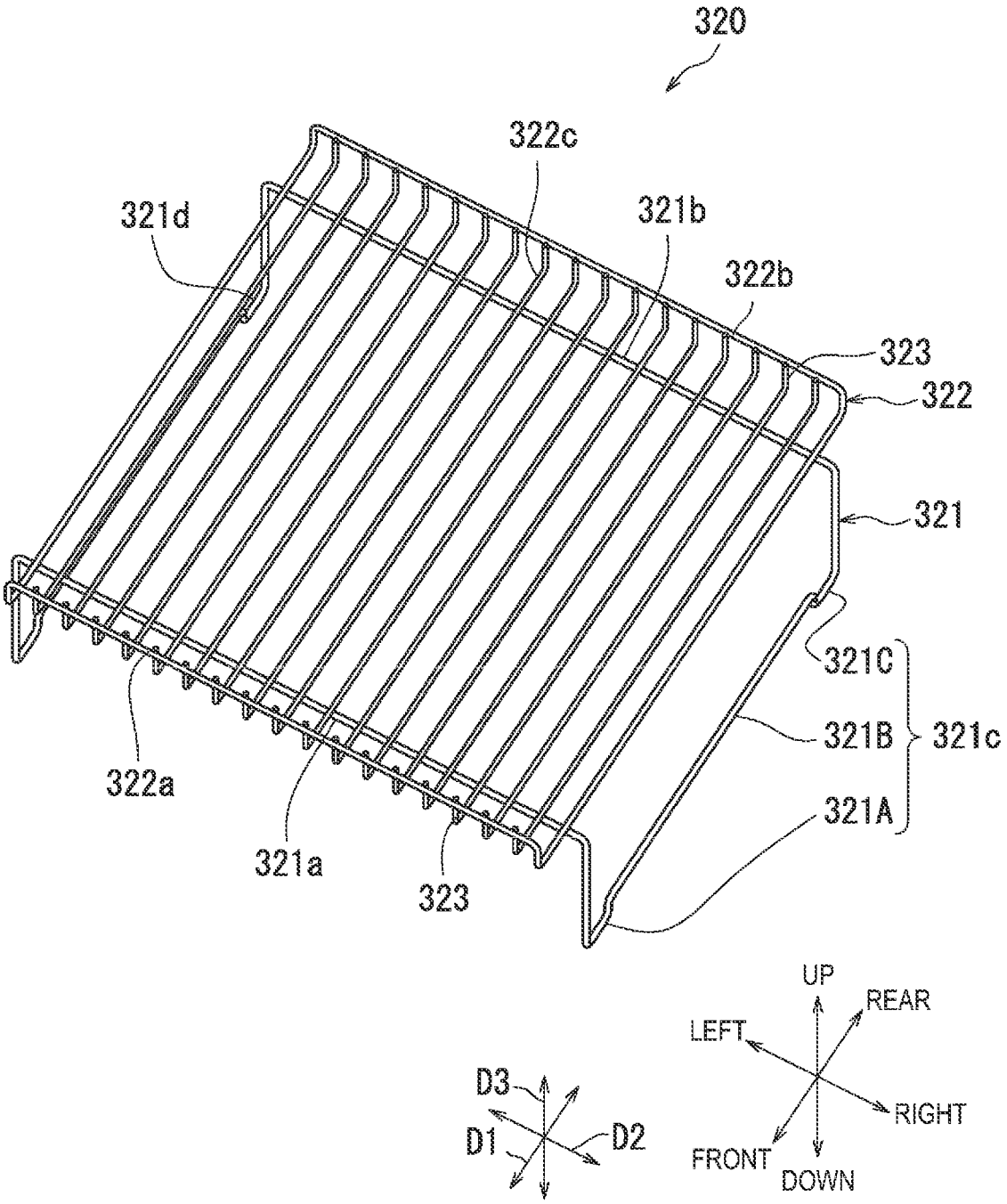
FIG. 7 is a perspective view illustrating a second grid body according to the first embodiment.

Next, the second grid body 320 will be specifically described with reference to FIG. 7. FIG. 7 is a perspective view illustrating the second grid body 320.

As illustrated in FIG. 7, the second grid body 320 includes a support portion 321 and a placement portion 322. Specifically, the placement portion 322 includes a front side metal rod 322*a*, a rear side metal rod 322*b*, and a plurality of metal rods 322*c*. Each of the front side metal rod 322*a* and the rear side metal rod 322*b* extends in the second direction D2.

Each of the plurality of metal rods 322*c* extends in the first direction D1. Specifically, one end of each of the plurality of metal rods 322*c* is connected to the front side metal rod 322*a*, and the other end of each of the plurality of metal rods 322*c* is connected to the rear side metal rod 322*b*. Further, in the plurality of metal rods 322*c*, the metal rods adjacent to each other in the second direction D2 are disposed at a predetermined interval. The object H to be heated is placed on the plurality of metal rods 322*c*.

The shape of the support portion 321 is, for example, a substantially quadrangular ring shape. Specifically, the support portion 321 includes a front side metal rod 321*a*, a rear side metal rod 321*b*, a right side metal rod 321*c*, and a left side metal rod 321*d*. Each of the right side metal rod 321*c* and the left side metal rod 321*d* includes a first low portion 321A, a high portion 321B, and a second low portion 321C. The first low portion 321A and the second low portion 321C are examples of a second leg portion. The high portion 321B is disposed between the first low portion 321A and the second low portion 321C. The height of each of the first low portion 321A and the second low portion 321C is lower than the height of the high portion 321B. As a result, deflection of the support portion 321 can be suppressed because the support portion 321 does not form a straight line.

In addition, each of lower surfaces of one end portions of the plurality of metal rods 322*c* is connected to the front side metal rod 321*a*, and each of lower surfaces of the other end portions of the plurality of metal rods 322*c* is connected to the rear side metal rod 321*b*. As a result, the placement portion 322 is positioned above the support portion 321. Note that a distance between the plurality of metal rods 322*c* and the high portion 321B is greater than a distance between the plurality of metal rods 312*c* and the high portion 311B.

Figure 8:
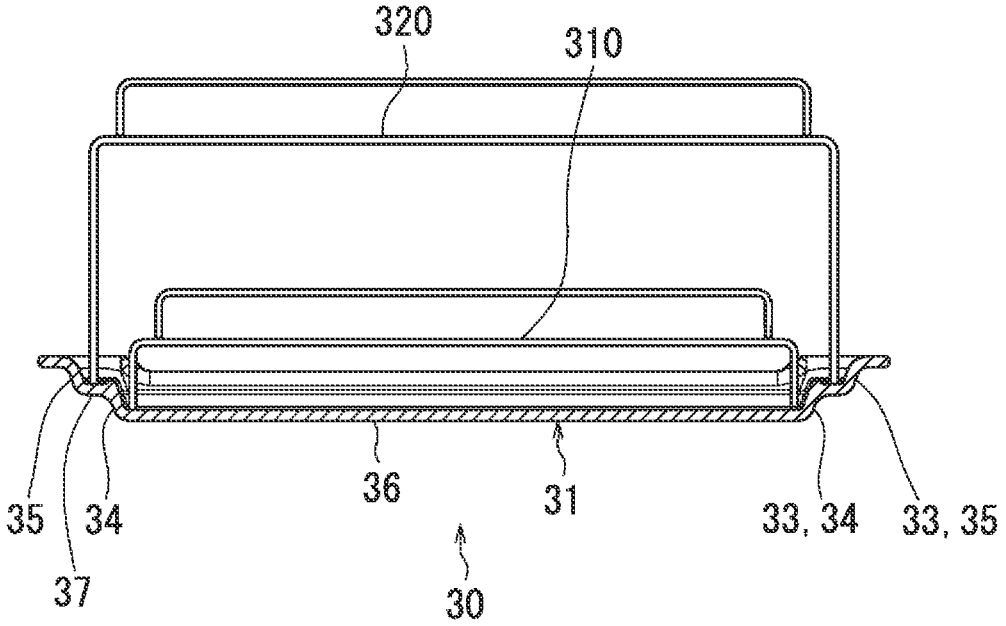
FIG. 8 is a cross-sectional view illustrating the tray and the grid body according to the first embodiment.

Next, the tray 30 will be specifically described with reference to FIG. 8. FIG. 8 is a cross-sectional view illustrating the tray 30 and the grid body 300. As illustrated in FIG. 8, the placement portion 31 of the tray 30 includes a grid body restricting portion 33 that restricts the movement of the grid body 300 with respect to the placement portion 31. Thus, it makes it possible to suppress the movement of the grid body 300 placed on the tray 30 with respect to the pull-out body 2 due to an impact when the pull-out body 2 moves. As a result, it makes it possible to suppress an excessive reduction in a distance between the grid body 300 and the pull-out body 2. Thus, it makes it possible to suppress the occurrence of discharging between the grid body 300 and the pull-out body 2.

Specifically, the placement portion 31 includes a plurality of grid body restricting portions 33. The plurality of grid body restricting portions 33 include a first grid body restricting portion 34 and a second grid body restricting portion 35. The first grid body restricting portion 34 restricts the movement of the first low portion 311A and the second low portion 311C. The second grid body restricting portion 35 restricts the movement of the first low portion 321A and the second low portion 321C.

Further, it is preferable that at least one grid body 300 include the first grid body 310 and the second grid body 320. With such a two-stage configuration, a large number of objects H to be heated can be heated without increasing the size. The first grid body restricting portion 34 restricts the movement of the first grid body 310. The second grid body restricting portion 35 restricts the movement of the second grid body 320. Accordingly, it makes it possible to suppress the movement of the first grid body 310 with respect to the pull-out body 2 due to an impact when the pull-out body 2 moves. Further, it makes it possible to suppress the movement of the second grid body 320 with respect to the pull-out body 2 due to an impact when the pull-out body 2 moves. Thus, it makes it possible to suppress the occurrence of discharging between the first grid body 310 and the pull-out body 2. In addition, it makes it possible to suppress the occurrence of discharging between the second grid body 320 and the pull-out body 2. Furthermore, it makes it possible to suppress the occurrence of discharging between the first grid body 310 and the second grid body 320.

Figure 9:
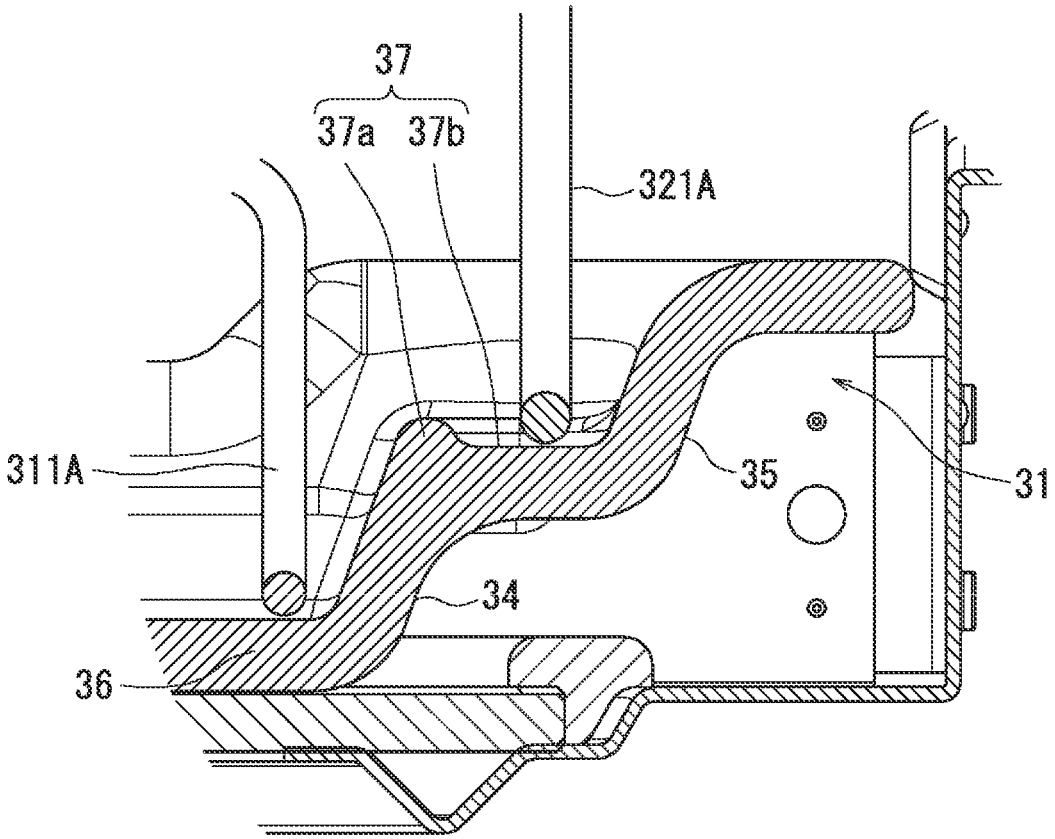
FIG. 9 is an enlarged cross-sectional view illustrating a placement portion and the grid bodies according to the first embodiment.

Next, the placement portion 31 will be specifically described in detail with reference to FIG. 9. FIG. 9 is an enlarged cross-sectional view illustrating the placement portion 31. As illustrated in FIG. 9, the placement portion 31 further includes a first grid body placement portion 36 and a second grid body placement portion 37. The position of the second grid body placement portion 37 is higher than the position of the first grid body placement portion 36. Specifically, the first grid body placement portion 36 is a rectangular plate-like member. The second grid body placement portion 37 is disposed at each of four corners of the placement portion 31. Specifically, each of the plurality of second grid body placement portions 37 includes a convex portion 37*a* and a flat surface portion 37*b*. The flat surface portion 37*b* is a horizontal surface that is long in the first direction D1. The convex portion 37*a* extends upward from the flat surface portion 37*b*. In addition, the first low portion 311A and the second low portion 311C are placed at four corners of the first grid body placement portion 36. The first low portion 321A and the second low portion 321C are placed at the flat surface portion 37*b* of the second grid body placement portion 37.

More specifically, the first grid body restricting portion 34 is a first wall portion. The first wall portion stands upright in the third direction D3 from the first grid body placement portion 36 to the second grid body placement portion 37. As a result, the outside of the first grid body 310 is in contact with the first wall. The second grid body restricting portion 35 is a second wall portion. The second grid body restricting portion 35 stands upright in the third direction D3 from the second grid body placement portion 37. As a result, the outside of the second grid body 320 is in contact with the second wall. Thus, it makes it possible to suppress the movement of the first grid body 310 and the second grid body 320 placed on the tray 30 with respect to the pull-out body 2 with a simple configuration. Additionally, each of the convex portions 37*a* of the second grid body placement portion 37 protrudes upward from the flat surface portion 37*b* between the first grid body restricting portion 34 and the flat surface portion 37*b*. Thus, it makes it possible to more suppress the movement of the second grid body 320.

In addition, the first grid body 310 further includes a heated object restricting portion 313. The heated object restricting portion 313 restricts the movement of an object H1 to be heated with respect to the first grid body 310. Specifically, one end portions of the plurality of metal rods 312*c* are bent upward. The plurality of metal rods 312*c* bent upward constitute the heated object restricting portion 313. The other end portions of the plurality of metal rods 312*c* are bent upward. The plurality of metal rods 312*c* bent upward constitute the heated object restricting portion 313. Accordingly, it makes it possible to more prevent the object H1 to be heated from falling from the first grid body 310 due to an impact when the pull-out body 2 moves.

The second grid body 320 further includes a heated object restricting portion 323. The heated object restricting portion 323 restricts the movement of an object H2 to be heated with respect to the second grid body 320. Specifically, one end portions of the plurality of metal rods 322*c* are bent upward. The other end portions of the plurality of metal rods 322*c* are bent upward. The plurality of metal rods 322*c* bent upward constitute the heated object restricting portion 313. Thus, the object H2 to be heated can further be suppressed from falling from the second grid body 320 due to an impact when the pull-out body 2 moves.

Next, a method of using the grid body 300 will be described. First, a user places the first grid body 310 on the first grid body placement portion 36. As a result, the first grid body restricting portion 34 can suppress the movement of the first grid body 310. Next, the user places the second grid body 320 on the second grid body placement portion 37. As a result, the second grid body restricting portion 35 can suppress the movement of the second grid body 320.

Next, the user moves the pull-out body 2 to the pull-out position. That is, a state where the base portion 22 is moved to the pull-out position is set. Next, the user grips the first protrusion portion 32A of the tray 30 with one hand wearing a glove, and grips the second protrusion portion 32B of the tray 30 with the other hand wearing a glove. Next, the user inserts the first protrusion portion 32A of the tray 30 into the right side concave portion 54A, inserts the second protrusion portion 32B of the tray 30 into the left side concave portion 54B, and places the tray 30 on the base portion 22. As a result, it makes it possible to suppress the movement of the tray 30 with respect to the pull-out body 2 due to an impact when the pull-out body 2 moves.

Figure 10:
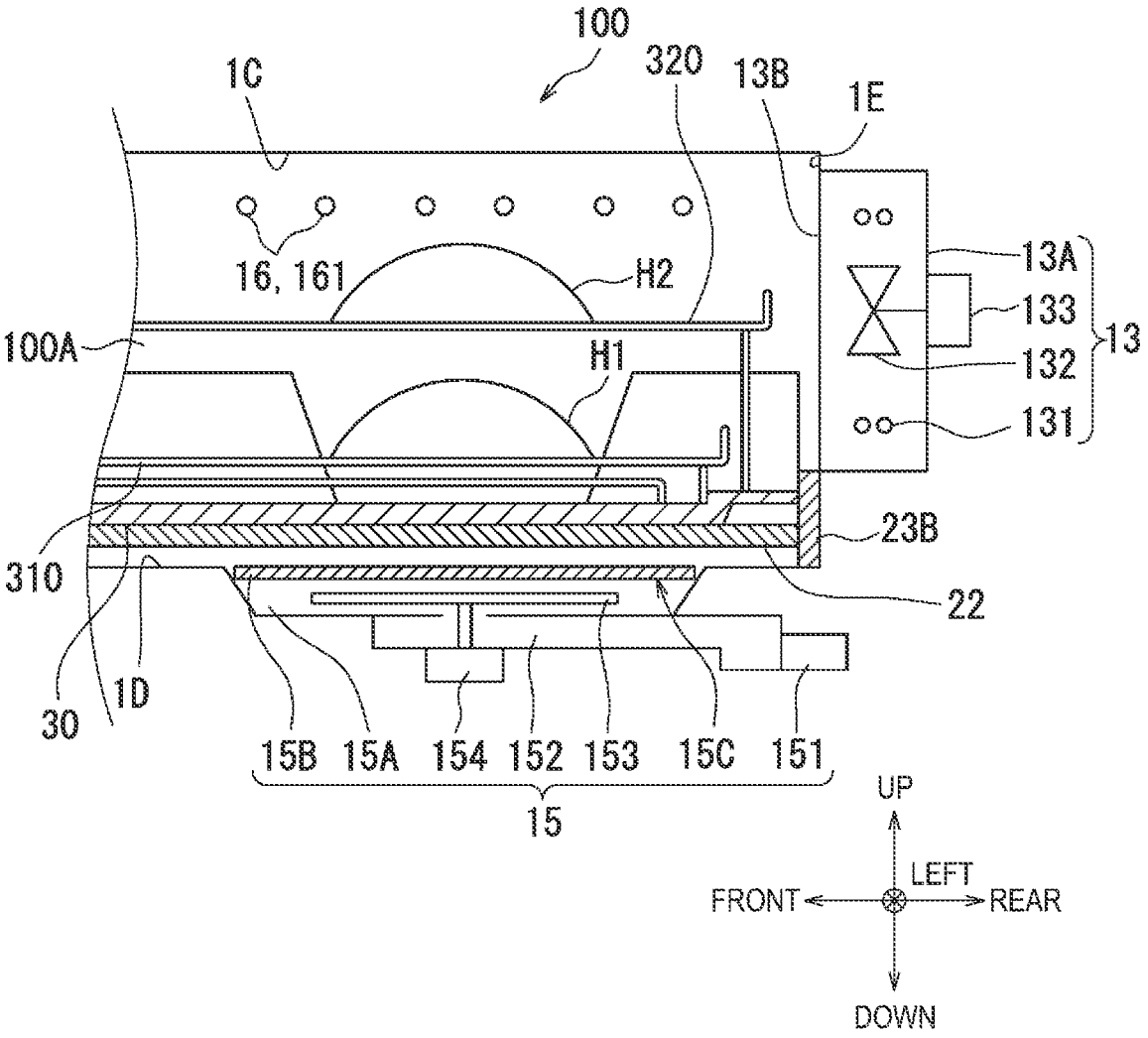
FIG. 10 is a cross-sectional view illustrating a heating chamber cut by a plane orthogonal to a second direction according to the first embodiment.

Next, the heating chamber 1 will be further described with reference to FIG. 10. FIG. 10 is a diagram illustrating a schematic cross-section of the heating chamber 1. In detail. FIG. 10 is a cross-sectional view illustrating the heating chamber 1 cut by a plane orthogonal to the second direction D2.

As illustrated in FIG. 10, the pull-out type heating cooking apparatus 100 further includes a microwave supply unit 15 and a partitioning member 15B. The microwave supply unit 15 supplies microwaves into the heating cooking chamber 100A.

The microwave supply unit 15 is positioned outside of the heating cooking chamber 100A through the bottom wall 1D. The microwave supply unit 15 includes a radiation chamber 15A, a magnetron 151, a waveguide 152, a rotary antenna 153, and an antenna motor 154. The magnetron 151 generates microwaves. The waveguide 152 propagates the microwaves generated by the magnetron 151 to the radiation chamber 15A.

The radiation chamber 15A includes a radiation port 15C. The shape of the radiation port 15C is, for example, a square shape. In addition, the radiation port 15C is positioned below the heating cooking chamber 100A. Specifically, the radiation port 15C is positioned at substantially a center portion of the bottom wall 1D. The rotary antenna 153 is accommodated in the radiation chamber 15A. The antenna motor 154 drives the rotary antenna 153. The rotary antenna 153 agitates microwaves and supplies the microwaves to the heating cooking chamber 100A through the radiation port 15C.

The partitioning member 15B covers the radiation port 15C. The partitioning member 15B is only required to have a shape that can cover the radiation port 15C. The partitioning member 15B is preferably a plate-like member. Further, the shape of the partitioning member 15B is, for example, a square shape when viewed from the vertical direction.

The material of the partitioning member 15B includes a ceramic or glass. As a result, because the material of the partitioning member 15B includes a ceramic or glass, the partitioning member 15B transmits microwaves. On the other hand, the material of each of the radiation chamber 15A and the waveguide 152 includes a metal.

In addition, as illustrated in FIG. 10, the pull-out type heating cooking apparatus 100 further includes a grill unit 16. Specifically, the grill unit 16 includes a heater 161 and an energization unit. The heater 161 is positioned in the heating cooking chamber 100A and heats the objects H1 and H2 to be heated. Specifically, the heater 161 is positioned at an upper portion in the heating cooking chamber 100A. The heater 161 has substantially a U shape when viewed from the vertical direction. In the present embodiment, three grill units 16 are disposed. The heater 161 is, for example, a sheathed heater. The energization unit is positioned outside the heating cooking chamber 100A. The energization unit energizes the heater 161. The energized heater 161 generates heat.

According to the pull-out type heating cooking apparatus 100 of the present invention, the heater 161 is provided at an upper portion in the heating cooking chamber 100A, and the microwave supply unit 15 is provided below the heating cooking chamber 100A. Thus, heat generated by the heater 161 is transmitted to the upper surfaces of the object H1 to be heated and the object H2 to be heated, and thus the upper surfaces of the objects H1 and H2 to be heated can be efficiently heated. In addition, the heater 161 does not inhibit the irradiation of the object H to be heated with microwaves.

Figure 11:
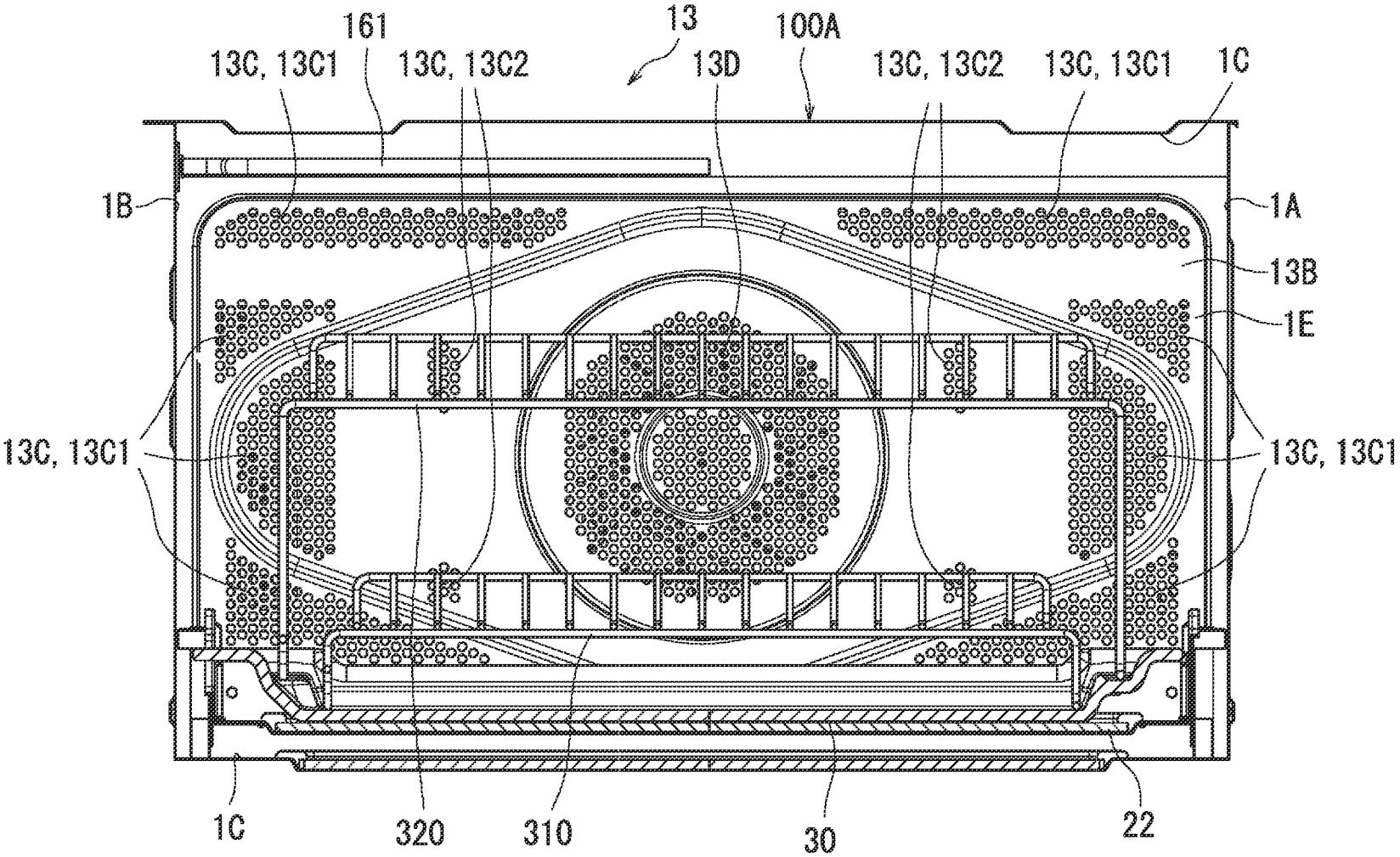
FIG. 11 is a cross-sectional view illustrating the heating chamber cut by a plane orthogonal to a first direction according to the first embodiment.

Next, an air sending unit 13 will be further described with reference to FIG. 10 and FIG. 11. FIG. 11 is a cross-sectional view illustrating the heating chamber 1 cut by a plane orthogonal to the first direction D1. As illustrated in FIG. 11, the pull-out type heating cooking apparatus 100 further includes the air sending unit 13. The air sending unit 13 supplies hot air into the heating cooking chamber 100A.

Specifically, the air sending unit 13 includes a suction hole portion 13D, a plurality of blow-out hole portions 13C, and a partitioning member 13B. The suction hole portion 13D is positioned on a side opposite to the first direction D1 with respect to the accommodation space 120. Each of the plurality of blow-out hole portions 13C is positioned on a side opposite to the first direction D1 with respect to the accommodation space 120. Specifically, the air sending unit 13 is positioned at the rear of the heating cooking chamber 100A via the back wall 1E. The suction hole portion 13D is positioned at the rear of the accommodation space 120. Each of the plurality of blow-out hole portions 13C is positioned at the rear of the accommodation space 120.

The air sending unit 13 suctions hot air in the heating cooking chamber 100A through the suction hole portion 13D and blows the hot air into the heating cooking chamber 100A through the plurality of blow-out hole portions 13C. More specifically, the air sending unit 13 suctions the hot air from a center portion in the heating cooking chamber 100A and blows out the hot air to a peripheral edge portion in the heating cooking chamber 100A. As a result, the entire space in the heating cooking chamber 100A can be heated by driving the air sending unit 13.

More specifically, the air sending unit 13 further includes an air sending chamber 13A, a heater 131, a centrifugal fan 132, and a drive unit 133. The air sending chamber 13A is, for example, a box-like member. The centrifugal fan 132 includes a plurality of blades.

The heater 131 and the centrifugal fan 132 are accommodated in the air sending chamber 13A. The heater 131 heats air inside the air sending chamber 13A to generate hot air. Specifically, the shape of the heater 131 is a circular ring when viewed from the front side to the rear side. In addition, the heater 131 is disposed along the outer circumference of the centrifugal fan 132.

The drive unit 133 is positioned outside the air sending chamber 13A. The drive unit 133 energizes the heater 131 and drives the centrifugal fan 132. The drive unit 133 includes, for example, a motor and an energization unit.

The partitioning member 13B is positioned at the rear of the accommodation space 120. Specifically, the partitioning member 13B is positioned between the air sending chamber 13A and the heating cooking chamber 100A. The partitioning member 13B is, for example, a plate-like member made of a metal. The shape of the partitioning member 13B is, for example, a rectangular shape when viewed from the front side to the rear side. The partitioning member 13B is disposed on substantially the entire surface of the back wall 1E. The suction hole portion 13D and the plurality of blow-out hole portions 13C are disposed in the partitioning member 13B. Thus, the suction hole portion 13D and the blow-out hole portions 13C can be easily disposed at the rear of the accommodation space 120.

Specifically, the suction hole portion 13D is, for example, an aggregate of a plurality of punched holes. Similarly, the blow-out hole portion 13C is, for example, an aggregate of a plurality of punched holes. Each of the punched holes has, for example, a circular shape. The diameter of each of the punched holes of the suction hole portion 13D and the blow-out hole portion 13C is, for example, 3.4 mm. Thus, each of the suction hole portion 13D and the blow-out hole portion 13C has a small size. As a result, it makes it possible to prevent a tool or the like from being caught in each of the suction hole portion 13D and the blow-out hole portion 13C when the heating cooking chamber 100A is cleaned.

More specifically, the blow-out hole portion 13C is disposed along the outer circumference of the partitioning member 13B. Specifically, the suction hole portion 13D is positioned at the center portion of the partitioning member 13B. On the other hand, the blow-out hole portion 13C includes intermediate blow-out holes 13C2 and peripheral blow-out holes 13C1.

The peripheral blow-out holes 13C1 are positioned between the center portion of the back wall 1E and the peripheral edge portion of the back wall 1E. The peripheral blow-out holes 13C1 are formed to make the temperature in the heating cooking chamber 100A uniform.

The intermediate blow-out holes 13C2 are positioned between the center portion of the back wall 1E and a peripheral edge portion of the back wall 1E. The intermediate blow-out holes 13C2 are formed to directly blow hot air onto the objects H1 and H2 to be heated which are placed on the grid body 300.

Here, a flow of the hot air will be described in detail. First, the air sending unit 13 suctions the hot air in the heating cooking chamber 100A into the air sending chamber 13A through the suction hole portion 13D by the centrifugal fan 132. The hot air suctioned into the air sending chamber 13A is heated by the heater 131. The air sending unit 13 blows the hot air in the air sending chamber 13A into the heating cooking chamber 100A through the blow-out hole portion 13C by the centrifugal fan 132. The hot air blown into the heating cooking chamber 100A from the peripheral blow-out holes 13C1 mainly moves forward along the right wall 1A and the left wall 1B. Thereafter, the hot air that has reached the rear surface 21B of the door portion 21 moves backward so that the movement direction of the hot air is reversed. Then, the hot air that has reached the objects H1 and H2 to be heated moves backward along the objects H1 and H2 to be heated. The hot air moving backward moves within the heating cooking chamber 100A. Thereafter, hot air F2 is suctioned into the air sending chamber 13A again from the suction hole portion 13D. In this manner, the air sending unit 13 circulates the hot air between the inside of the air sending chamber 13A and the inside of the heating cooking chamber 100A. On the other hand, the hot air blown out from the intermediate blow-out holes 13C2 in the heating cooking chamber 100A is mainly blown directly onto the objects H1 and H2 to be heated which are placed on the grid body 300.

As described above, according to the pull-out type heating cooking apparatus 100, the blow-out hole portion 13C includes the intermediate blow-out holes 13C2 and the peripheral blow-out holes 13C1. Thus, the objects H1 and H2 to be heated which are placed on the grid body 300 can be heated more uniformly.

Figure 12:
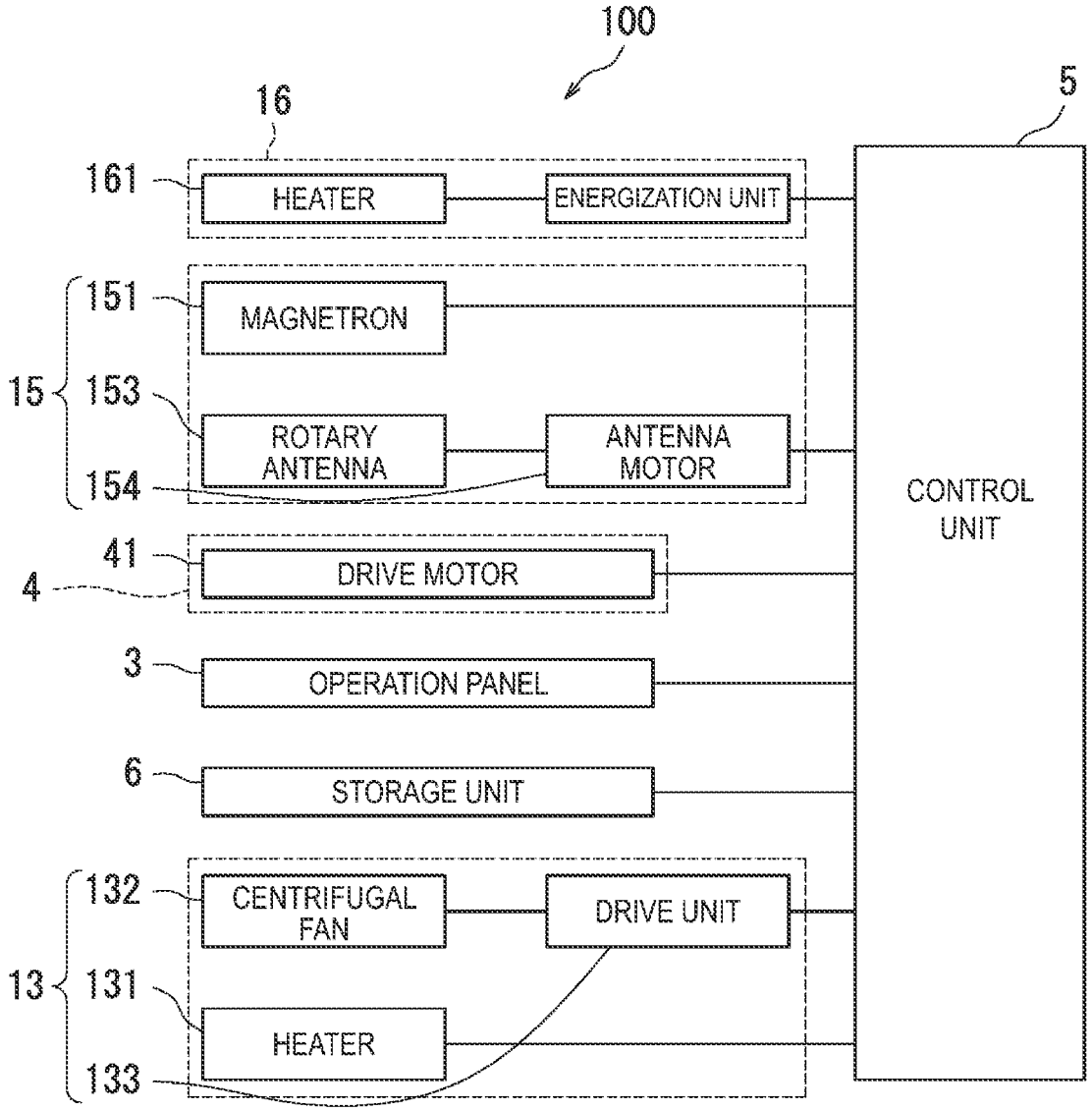
FIG. 12 is a block diagram illustrating a configuration of the pull-out type heating cooking apparatus according to the first embodiment.

A configuration of the pull-out type heating cooking apparatus 100 will be described in detail with reference to FIG. 12. FIG. 12 is a block diagram illustrating the configuration of the pull-out type heating cooking apparatus 100. In the present embodiment, the pull-out type heating cooking apparatus 100 has a "microwave heating mode," a "hot air circulation heating mode," and a "grill heating mode" as heating cooking modes. The "microwave heating mode" is mainly a mode in which the objects H1 and H2 to be heated are heated and cooked by radiating microwaves into the heating cooking chamber 100A. The "grill heating mode" is mainly a mode in which the objects H1 and H2 to be heated are heated and cooked by conducting heat generated by transmitting heat generated by the heater 161 to the objects H1 and H2 to be heated. The "hot air circulation heating mode" is mainly a mode in which the objects H1 and H2 to be heated are heated and cooked by circulating hot air in the entire heating cooking chamber 100A to make the temperature in the heating cooking chamber 100A uniform.

As illustrated in FIG. 12, the control unit 5 controls the drive unit 133, the magnetron 151, the antenna motor 154, the energization unit, the drive motor 41, the operation panel 3, the drive unit 133, and the storage unit 6 by executing the control programs stored in the storage unit 6.

Specifically, the control unit 5 controls the driving of the microwave supply unit 15, the driving of the air sending unit 13, and the driving of the grill unit 16. For example, in a case where the "microwave heating mode" is selected, the control unit 5 drives the magnetron 151 and the antenna motor 154. Further, in a case where the "grill heating mode" is selected, the control unit 5 energizes the energization unit. Further, in a case where the "hot air circulation heating mode" is selected, the control unit 5 drives the drive unit 133. The drive unit 133 energizes the heater 131 and drives the centrifugal fan 132.

Figure 13:
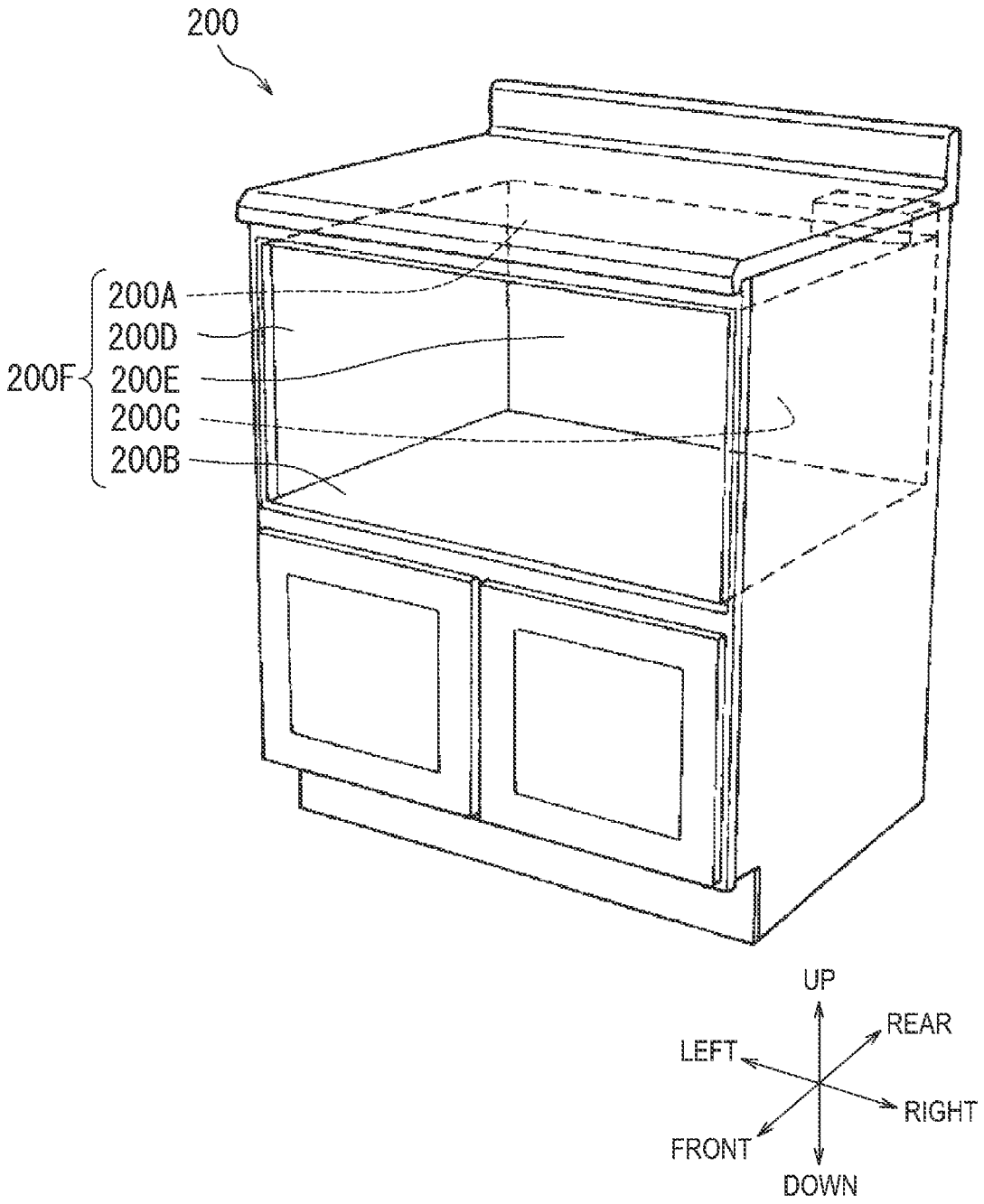
FIG. 13 is a perspective view illustrating a cabinet to which the pull-out type heating cooking apparatus according to the first embodiment is attached.

Subsequently, a cabinet 200 to which the pull-out type heating cooking apparatus 100 is attached will be described with reference to FIG. 13. FIG. 13 is a diagram illustrating the cabinet 200 to which the pull-out type heating cooking apparatus 100 is attached.

As illustrated in FIG. 13, the pull-out type heating cooking apparatus 100 is attached to and installed in the cabinet 200. The cabinet 200 includes an upper wall 200A, a lower wall 200B, a right wall 200C, a left wall 200D, and a rear wall 200E. The upper wall 200A, the lower wall 200B, the right wall 200C, the left wall 200D, and the rear wall 200E form an accommodation portion 200F. The accommodation portion 200F is a rectangular parallelepiped space into which the pull-out type heating cooking apparatus 100 is fitted.

Second Embodiment

Figure 14:
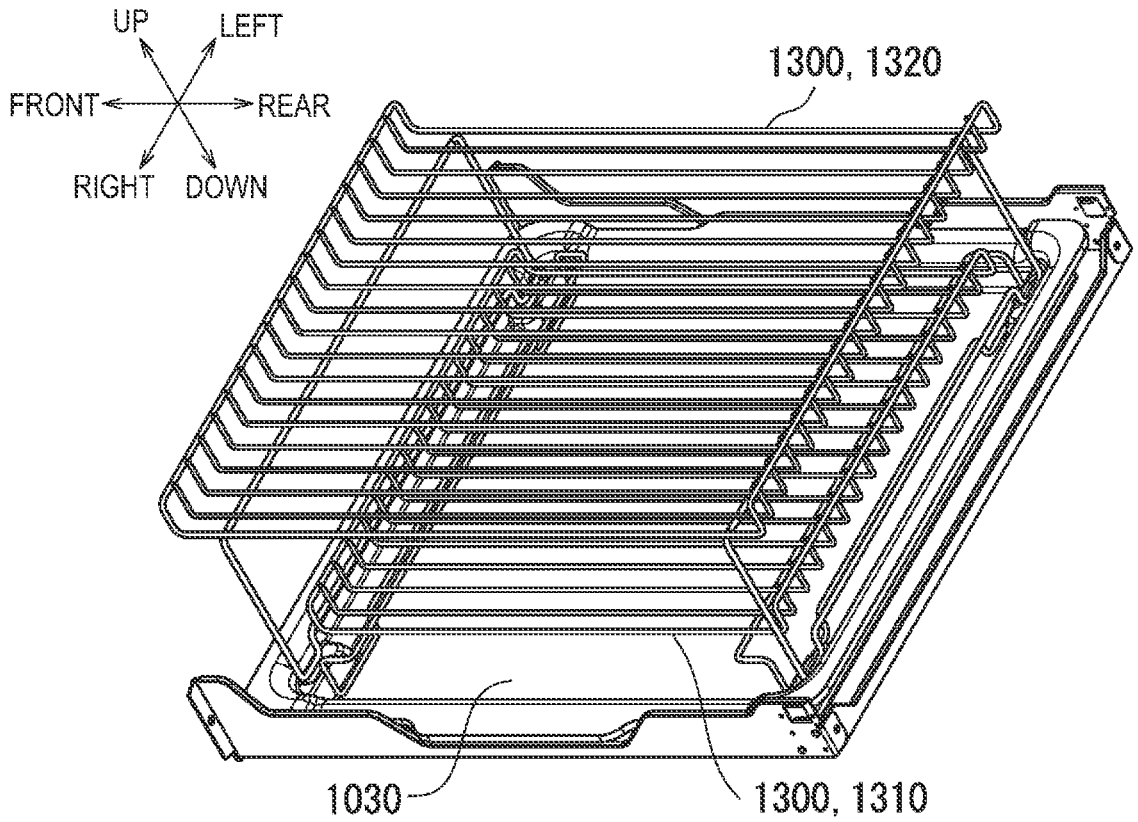
FIG. 14 is a perspective view illustrating a tray and a grid body according to a second embodiment of the present invention.

A configuration of a pull-out type heating cooking apparatus according to a second embodiment will be described with reference to FIG. 14. FIG. 14 is a perspective view illustrating a grid body 1300 and a tray 1030. The shapes of the grid body 300 and the tray 30 in the pull-out type heating cooking apparatus 100 according to the first embodiment are different from the shapes of the grid body 1300 and the tray 1030 in the pull-out type heating cooking apparatus according to the second embodiment. In the following description, the grid body 1300 and the tray 1030 will be mainly described.

As illustrated in FIG. 14, the pull-out type heating cooking apparatus further includes at least one grid body 130) and the tray 1030. In the embodiment, the at least one grid body 1300 includes a first grid body 1310 and a second grid body 1320.

Figure 15:
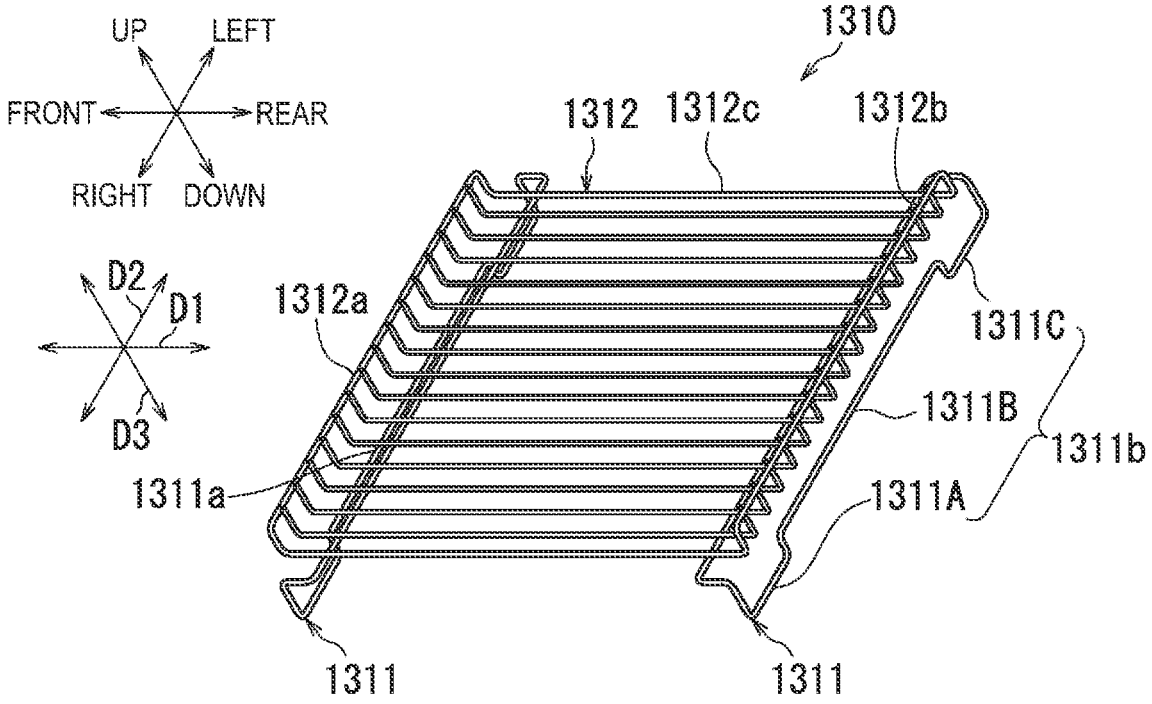
FIG. 15 is a perspective view illustrating a first grid body according to the second embodiment.

The first grid body 1310 will be described in detail with reference to FIG. 15. FIG. 15 is a perspective view illustrating the first grid body 1310. As illustrated in FIG. 15, the first grid body 1310 includes a pair of support portions 1311 and a placement portion 1312. Specifically, the placement portion 1312 includes a front side metal rod 1312*a*, a rear side metal rod 1312*b*, and a plurality of metal rods 1312*c*. Each of the front side metal rod 1312*a* and the rear side metal rod 1312*b* extends in the second direction D2.

Each of the plurality of metal rods 1312*c* extends in the first direction D1. Specifically, one end of each of the plurality of metal rods 1312*c* is connected to the front side metal rod 1312*a*, and the other end of each of the plurality of metal rods 1312*c* is connected to the rear side metal rod 1312*b*. Additionally, in the plurality of metal rods 1312*c*, the metal rods adjacent to each other in the second direction D2 are disposed at a predetermined interval. An object H to be heated is placed on the plurality of metal rods 1312*c*.

Each of the pair of support portions 1311 includes an upper metal rod 1311*a* and a lower metal rod 1311*b*. Each of the upper metal rod 1311*a* and the lower metal rod 1311*b* extends in the second direction D2. The lower metal rod 1311*b* includes a first low portion 1311A, a high portion 1311B, and a second low portion 1311C. The first low portion 1311A and the second low portion 1311C are examples of a first leg portion. The high portion 1311B is disposed between the first low portion 1311A and the second low portion 1311C. The height of each of the first low portion 1311A and the second low portion 1311C is lower than the height of the high portion 1311B.

In addition, lower surfaces of one end portions and the other end portions of the plurality of metal rods 1312*c* are connected to the upper metal rod 1311*a* of the pair of support portions 1311.

Figure 16:
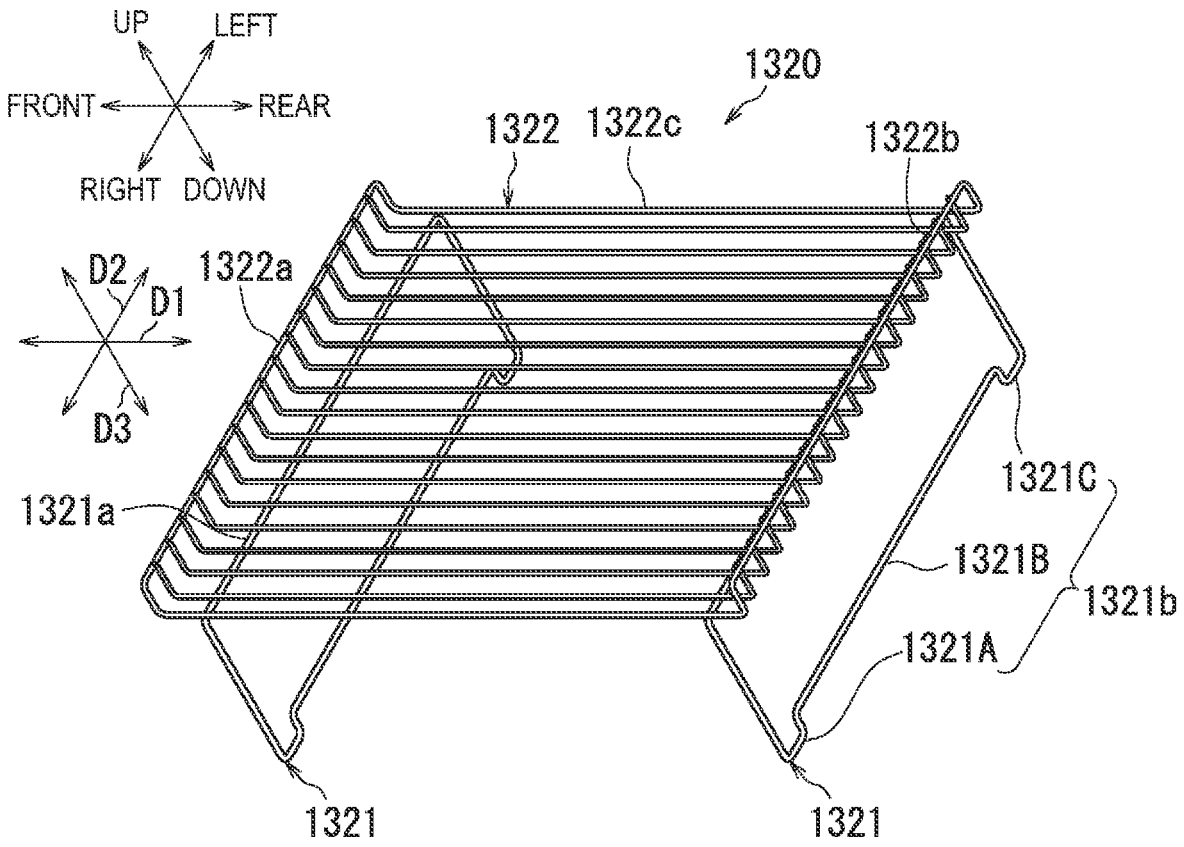
FIG. 16 is a perspective view illustrating a second grid body according to the second embodiment.

Next, the second grid body 1320 will be described in detail with reference to FIG. 16. FIG. 16 is a perspective view illustrating the second grid body 1320. As illustrated in FIG. 16, the second grid body 1320 includes a pair of support portions 1321 and a placement portion 1322. Specifically, the placement portion 1322 includes a front side metal rod 1322*a*, a rear side metal rod 1322*b*, and a plurality of metal rods 1322*c*. Each of the front side metal rod 1322*a* and the rear side metal rod 1322*b* extends in the second direction D2.

Each of the plurality of metal rods 1322*c* extends in the first direction D1. Specifically, one end of each of the plurality of metal rods 1322*c* is connected to the front side metal rod 1322*a*, and the other end of each of the plurality of metal rods 1322*c* is connected to the rear side metal rod 1322*b*. Further, in the plurality of metal rods 1322*c*, the metal rods adjacent to each other in the second direction D2 are disposed at a predetermined interval. The object H to be heated is placed on the plurality of metal rods 1322*c*.

Each of the pair of support portions 1321 includes an upper metal rod 1321*a* and a lower metal rod 1321*b*. Each of the upper metal rod 1321*a* and the lower metal rod 1321*b* extends in the second direction D2. The lower metal rod 1321*b* includes a first low portion 1321A, a high portion 1321B, and a second low portion 1321C. The first low portion 1321A and the second low portion 1321C are examples of a second leg portion. The high portion 1321B is disposed between the first low portion 1321A and the second low portion 1321C. The height of each of the first low portion 1321A and the second low portion 1321C is lower than the height of the high portion 1321B.

Further, lower surfaces of one end portions and the other end portions of the plurality of metal rods 1322*c* are connected to the upper metal rods 1321*a* of the pair of support portions 1321, respectively. Note that a distance between the plurality of metal rods 1322*c* and the high portion 1321B is greater than a distance between the plurality of metal rods 1312*c* and the high portion 13111B.

Figure 17:
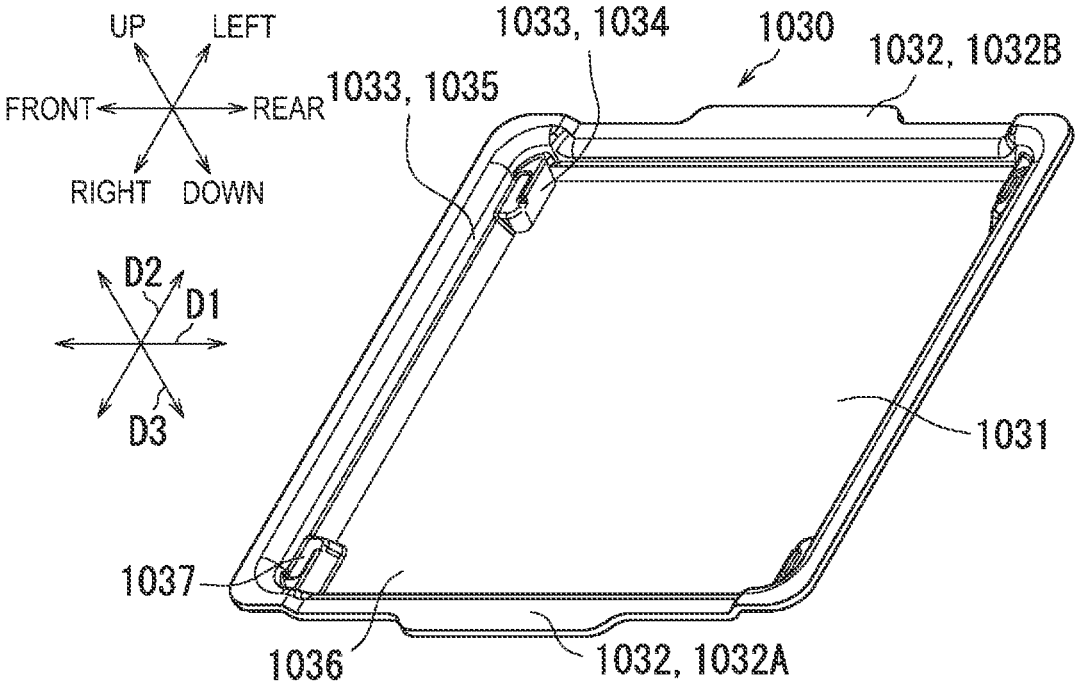
FIG. 17 is a perspective view illustrating the tray according to the second embodiment.

Next, the tray 1030 will be described in detail with reference to FIG. 17. FIG. 17 is a perspective view illustrating the tray 1030. As illustrated in FIG. 17, the tray 1030 includes a placement portion 1031 and a pair of protrusion portions 1032.

The pair of protrusion portions 1032 protrude from the placement portion 1031 in the second direction D2 so as to be separated from each other. Specifically, one protrusion portion of the pair of protrusion portions 1032 includes a first protrusion portion 1032A, the other protrusion portion of the pair of protrusion portions 1032 includes a second protrusion portion 1032B. The pair of protrusion portions 1032 are respectively disposed in a pair of concave portions 54.

The placement portion 1031 of the tray 1030 includes a grid body restricting portion 1033 that restricts the movement of the grid body 1300 with respect to the placement portion 1031.

Specifically, the placement portion 1031 includes a plurality of grid body restricting portions 1033. The plurality of grid body restricting portions 1033 include a first grid body restricting portion 1034 and a second grid body restricting portion 1035. The first grid body restricting portion 1034 restricts the movement of the first low portion 1311A and the second low portion 1311C. The second grid body restricting portion 1035 restricts the movement of the first low portion 1321A and the second low portion 1321C.

The placement portion 1031 further includes a first grid body placement portion 1036 and a second grid body placement portion 1037. The position of the second grid body placement portion 1037 is higher than the position of the first grid body placement portion 1036. Specifically, the first grid body placement portion 1036 is a rectangular plate-like member. The second grid body placement portion 1037 is disposed at each of four corners of the placement portion 1031. Specifically, each of the plurality of second grid body placement portions 1037 includes a horizontal surface that is long in the second direction D2. The first low portion 1311A and the second low portion 1311C are placed on the first grid body placement portion 1036. The first low portion 1321A and the second low portion 1321C are placed on a flat surface portion of the second grid body placement portion 1037.

More specifically, the first grid body restricting portion 1034 is a first wall portion. The first wall portion stands upright in the third direction D3 from the first grid body placement portion 1036 to the second grid body placement portion 1037. As a result, the outside of the first grid body 1310 is in contact with the first wall portion. The second grid body restricting portion 1035 is a second wall portion. The second grid body restricting portion 1035 stands upright in the third direction D3 from the second grid body placement portion 1037. As a result, the outside of the second grid body 1320 is in contact with the second wall portion.

Thus, it makes it possible to suppress the movement of the first grid body 1310 with respect to the pull-out body 2 due to an impact when the pull-out body 2 moves. Additionally, it makes it possible to suppress the movement of the second grid body 1320 with respect to the pull-out body 2 due to an impact when the pull-out body 2 moves. Thus, it makes it possible to suppress the occurrence of discharging between the first grid body 1310 and the pull-out body 2. In addition, it makes it possible to suppress the occurrence of discharging between the second grid body 1320 and the pull-out body 2. Furthermore, it makes it possible to suppress the occurrence of discharging between the first grid body 1310 and the second grid body 1320.

The embodiments of the present invention have been described above with reference to the drawings. However, the present invention is not limited to the embodiments described above, and the present invention can be implemented in various modes without departing from the gist thereof. The drawings primarily schematically illustrate each of the constituent elements for the sake of easier understanding, and the thickness, length, quantity, and the like of each of the illustrated constituent elements are different from the actual thickness, length, quantity, and the like by reason of creation of the drawings. Further, the material, shape, dimensions, and the like of each of the constituent elements illustrated in the embodiments described above are merely examples and are not particularly limited, and various modifications can be made within the scope not substantially departing from the effects of the present invention.

(1) As described with reference to FIG. 1 to FIG. 17, the pull-out type heating cooking apparatus 100 includes the air sending unit 13, but the present invention is not limited thereto. For example, the pull-out type heating cooking apparatus 100 may further include an air sending unit different from the air sending unit 13.

(2) As described with reference to FIG. 1 to FIG. 17, each of the blow-out hole portion 13C and the suction hole portion 13D is an aggregate of a plurality of punched holes, but the present invention is not limited thereto. For example, each of the blow-out hole portion 13C and the suction hole portion 13D may be one opening portion, may be a plurality of slit holes, or may be a net-like portion.

(3) As described with reference to FIG. 1 to FIG. 17, the first embodiment in which the grid body 300 and the tray 30 are combined has been described, and the second embodiment in which the grid body 1300 and the tray 1030 are combined have been described, but the present invention is not limited thereto. For example, the grid body 300 and the tray 1030 may be combined, and the grid body 1300 and tray 30 may be combined.

INDUSTRIAL APPLICABILITY

The present invention is useful in the field of a heating cooking apparatus, for example.

REFERENCE SIGNS LIST

1 Heating chamber
2 Pull-out body (pull-out portion)
15 Microwave supply unit
22 Base portion
30 Tray (placement member)
31 Placement portion
32 Protrusion portion
33 Grid body restricting portion
34 First grid body restricting portion
35 Second grid body restricting portion
36 First grid body placement portion
37 Second grid body placement portion
50 Side wall portion
54 Concave portion
100 Pull-out type heating cooking apparatus
100A Heating cooking chamber
300 Grid body
310 First grid body
311A First low portion (first leg portion)
311B High portion
311C Second low portion (first leg portion)
313 Heated object restricting portion
320 Second grid body
321A First low portion (second leg portion)
321B High portion
321C Second low portion (second leg portion)
323 Heated object restricting portion

The invention claimed is:

1. A heating cooking apparatus comprising:
a heating cooking chamber;
a pull-out portion configured to be pulled out from the heating cooking chamber in a first direction; and
a placement member placed on the pull-out portion,
wherein the placement member includes:
a placement portion on which an object is placed, and
a pair of protrusion portions protruding from the placement portion in a second direction intersecting the first direction, the pair of protrusion portions located on two opposite sides of the placement member,
the pull-out portion includes:
a base portion on which the placement member is placed, and
a pair of side wall portions extending in the first direction, standing upright from the base portion, and facing each other in the second direction,
the pair of side wall portions includes, respectively, a pair of concave portions recessed in a third direction intersecting the first direction and the second direction, and
the pair of protrusion portions is disposed, respectively, in the pair of concave portions and protrudes outward from the pair of concave portions when the placement member is placed inside the pull-out portion, and
the second direction and the first direction are perpendicular to each other and located on a plane that is parallel to a top surface of the placement portion.

2. The heating cooking apparatus according to claim 1, further comprising:
a grid body as the object,
wherein the placement portion includes a grid body restricting portion configured to restrict a movement of the grid body with respect to the placement portion.

3. The heating cooking apparatus according to claim 2, further comprising:
a plurality of grid bodies, including the grid body,
wherein the placement portion further includes a plurality of grid body restricting portions, including the grid body restricting portion,
the plurality of grid bodies includes:
a first grid body including a first leg portion, and
a second grid body including a second leg portion,
the second grid body is disposed on the placement member and separated above from the first grid body, and
the plurality of grid body restricting portions includes:
a first grid body restricting portion configured to restrict a movement of the first leg portion, and
a second grid body restricting portion configured to restrict a movement of the second leg portion.

4. The heating cooking apparatus according to claim 3, wherein the placement portion further includes:
a first grid body placement portion on which the first leg portion is placed, and
a second grid body placement portion on which the second leg portion is placed,
a position of the second grid body placement portion is higher than a position of the first grid body placement portion,
the first grid body restricting portion is a first wall portion standing upright in the third direction from the first grid body placement portion to the second grid body placement portion, and
the second grid body restricting portion is a second wall portion standing upright in the third direction from the second grid body placement portion.

5. The heating cooking apparatus according to claim 4, wherein the second grid body placement portion includes:
a flat surface portion on which the second leg portion is placed, and
a convex portion protruding upward from the flat surface portion between the first grid body restricting portion and the flat surface portion.

6. The heating cooking apparatus according to claim 2, further comprising:
a microwave supply unit configured to supply microwaves to the heating cooking chamber,
wherein the grid body is made of a metal,
the pair of side wall portions is made of a metal, and
the placement member is made of a non-metal.

7. The heating cooking apparatus according to claim 2, wherein the grid body includes a heated object restricting portion configured to restrict a movement of an object to be heated with respect to the grid body.

8. The heating cooking apparatus according to claim 2, further comprising:

a heater configured to heat an object that is to be heated and that is placed on the grid body.

* * * * *